US007316368B2

(12) United States Patent
Moon et al.

(10) Patent No.: US 7,316,368 B2
(45) **Date of Patent: *Jan. 8, 2008**

(54) DIRECT CURRENT POWERED HOSE REWINDING APPARATUS

(75) Inventors: Brian Moon, De Kalb, IL (US); Lyle A. Rosine, Batavia, IL (US); Torrence Anderson, Overland Park, KS (US); Adam Thomas, Wheaton, IL (US); Michael Uffner, Naperville, FL (US)

(73) Assignee: Suncast Corporation, Batavia, IL (US)

( * ) Notice: Subject to any disclaimer, the term of this patent is extended or adjusted under 35 U.S.C. 154(b) by 163 days.

This patent is subject to a terminal disclaimer.

(21) Appl. No.: 10/917,921

(22) Filed: Aug. 12, 2004

(65) Prior Publication Data

US 2005/0017117 A1 Jan. 27, 2005

Related U.S. Application Data

(63) Continuation-in-part of application No. 10/649,015, filed on Aug. 25, 2003, now Pat. No. 6,913,221, which is a continuation-in-part of application No. 10/346,908, filed on Jan. 17, 2003, now Pat. No. 6,877,687.

(51) Int. Cl.
*B65H 75/48* (2006.01)

(52) U.S. Cl. ..... 242/390.9; 242/394.1; 242/395.1; 137/355.2; 137/355.27

(58) Field of Classification Search ..... 242/390, 242/390.8, 390.9, 394, 394.1, 395, 395.1, 242/356, 356.7, 406; 137/355.12, 355.2, 137/355.26, 355.27
See application file for complete search history.

(56) References Cited

U.S. PATENT DOCUMENTS 2,257,837 A * 10/1941 Burge et al. ..... 242/444.5

(Continued)

*Primary Examiner*—Peter M. Cuomo
*Assistant Examiner*—William E Dondero
(74) *Attorney, Agent, or Firm*—McHale & Slavin, P.A.

(57) ABSTRACT

The present invention relates to portable hose carts for handling and storage of flexible hoses, such as garden or air hoses. The cart is primarily constructed of plastic components having a centrally rotatable spool for winding of the flexible hose, an enclosure for supporting the spool, wheels at one end of the base of the enclosure, and a handle assembly for tilting the frame onto the wheels to facilitate moving the device. The handle assembly is telescoping mounted and includes a handle mounted near the top of the handle assembly. The spool is rotatable by either a direct current powered motor or a folding manual crank. Power from the electrical motor is transferred to the spool via an infinitely adjustable torque transfer assembly. When the cover is in the open position, the direct current motor is operationally locked out, and when the cover is rotated into the closed position, the direct current motor is operable. The device may further include a reciprocating guide assembly that operates during rotation of the spool to rewind the hose into a compact configuration.

51 Claims, 19 Drawing Sheets

U.S. PATENT DOCUMENTS

| | | | | | |
|---|---|---|---|---|---|
| 2,606,067 | A | | 8/1952 | Roark | |
| 2,893,656 | A | * | 7/1959 | Carlson | 242/396.9 |
| 3,315,914 | A | * | 4/1967 | Turner | 242/390.1 |
| 4,012,002 | A | | 3/1977 | McDonald et al. | |
| 4,043,517 | A | * | 8/1977 | Jahrig | 242/486 |
| 4,196,874 | A | * | 4/1980 | Ohara | 242/356.7 |
| 4,377,264 | A | * | 3/1983 | Kovaleski et al. | 242/473.9 |
| 4,431,144 | A | * | 2/1984 | Foster | 242/406 |
| 4,513,772 | A | | 4/1985 | Fisher | |
| 4,764,998 | A | * | 8/1988 | Norris et al. | 4/502 |
| 4,832,074 | A | | 5/1989 | Li | |
| 4,979,688 | A | * | 12/1990 | Tinker et al. | 242/486.8 |
| 5,495,995 | A | | 3/1996 | Dominique et al. | |
| 5,587,569 | A | | 12/1996 | Mohtasham | |
| 5,732,648 | A | * | 3/1998 | Aragon | 114/254 |
| 5,897,430 | A | | 4/1999 | Haller | |
| 6,050,290 | A | | 4/2000 | Yacobi et al. | |
| D432,002 | S | | 10/2000 | Anderson et al. | |
| 6,149,096 | A | | 11/2000 | Hartley | |
| 6,338,360 | B2 | | 1/2002 | Spear et al. | |
| 6,877,687 | B2 | * | 4/2005 | Moon et al. | 242/390.8 |
| 6,913,221 | B2 | * | 7/2005 | Moon et al. | 242/390.8 |
| 2002/0014551 | A1 | * | 2/2002 | Tuttlebee | 242/390.8 |

* cited by examiner

DIRECT CURRENT POWERED HOSE REWINDING APPARATUS

CROSS REFERENCE TO RELATED APPLICATIONS

This application is a continuation-in-part of applicant's U.S. application Ser. No. 10/649,015 filed Aug. 25, 2003, now U.S. Pat. No. 6,913,221 which is a continuation-in-part of U.S. application Ser. No. 10/346,908 filed Jan. 17, 2003, now U.S. application Ser. No. 6,877,687 the contents of which are each hereby incorporated by reference in their entirety.

FIELD OF THE INVENTION

This invention is directed to hose rewinding apparatus for flexible hoses. More specifically, the present invention relates to a direct current powered, motor driven hose rewinding apparatus with manual override that is mounted within a protective safety enclosure. The safety enclosure includes a telescoping handle and a pair of wheels for easy transport and storage.

BACKGROUND INFORMATION

The prior art has proposed a number of different structures for rewinding and storing a hose when it is not in use. These devices generally include stationary hose reel hangers that can be mounted to a surface of a building, such as an outer wall of a house, or portable hose reel carts that permit ready transport of the hose from one location to another.

In the past it was common to retrieve hoses and the like by manually winding them around a suitable structure, such as a wall mounted hanger, or simply bundling them into loose coils. Surface (or wall) mounted hose reels or hangers come in a wide variety of configurations. For example, one surface mounted hose hanger includes a simple, semi-circular metal or plastic support that is mounted to the building, over which the hose is looped or hung. Another surface mounted device or reel includes a rotatable fitting that is mounted to the building surface to which a manually rotated reel is mounted. Unfortunately, when hose is pulled out from such manually wound devices, it often becomes snarled or tangled and requires appreciable time and effort to correct the situation. Additionally, these surface mounted reels and hangers are often considered unsightly, particularly if they are mounted to the front of the building and are not covered or otherwise obscured by plants or foliage.

Portable hose reel carts permit ready transport of the hose from one location to another. Portable hose reel carts typically include an open, manually rotatable reel or spool positioned between a pair of side frames with wheels. The hose is manually wound upon the reel for storage and pulled or dispensed from the reel for use.

Although such carts have become wide spread in use because of their portable storage capabilities, they do have drawbacks. First, these devices require manual winding of the hose. Rewinding long hoses requires a considerable effort. Due to the low positional location of the winding mechanism on these devices, many users may be physically unable to complete the rewinding. Additionally, a hose stored on such a reel is exposed to the elements. Often hoses are made of rubber or like materials that can become stiff or brittle and can break when subjected to ultra-violet radiation or low temperature extremes, particularly with advanced age.

Portable hose reel carts may also be considered by some to be unsightly. Given that most hose reel carts are designed for use in and around garden and lawn areas, it is expected and natural for these carts to become dirty. As such, some users may be inclined to constantly remove a hose reel cart, particularly from the front of a house, when, for example, the cart becomes dirty, muddy or discolored.

In an effort to solve some of these problems, a number of hose retrieval devices have been developed which automatically retrieve and rewind hose on a reel in such a manner so as to avoid tangling the next time the hose is deployed or paid out. Such devices generally include a reel and a level wind mechanism for guiding the hose onto the reel. The level wind mechanism includes a traversing screw, a guide rod, and a follower. The reel is generally directly driven by a motor and/or an intermeshing clutch assembly. Unfortunately, the electric motors of the prior art devices have voltage requirements that reduce portability and increase the risk of electrical shock. Additionally, the clutch mechanisms utilized on these devices are either completely engaged or completely disengaged and lack an infinitely adjustable torque transfer assembly to allow operator controlled speed and/or force of hose retrieval.

Unfortunately, many of these motorized devices also lack a suitably safe enclosure to protect the operator and/or small children from being accidentally caught in the device. For example, none of the motorized hose reels known are equipped with safety interlocks to prevent the motor from being engaged if an enclosure cover is opened. To compound the problem, many of these devices do not provide for an emergency stop and require the entire hose to be retracted before the device can be stopped. Retracting the entire hose may take several seconds and exacerbates emergency situations such as when a person or pet has been caught in the machine or in the hose as it is retracted. In addition, none of the devices known provide a disengaging hose winding guide. The level winds of the prior art are capable of causing severe damage to an operator, child or pet that may accidentally get caught in the rewinding device.

Accordingly, there exists a need for a rechargeable battery operated motorized hose rewinding and storage device that permits safe motorized take-up and manual dispensing of a hose that is also aesthetically pleasing. Such a hose rewinding and storage device that can be safely used to retract and "hide-away" the hoses stored therein when not in use. The hose rewinding device should also be constructed for easy transport and storage while maintaining a overall compact profile.

DESCRIPTION OF THE PRIOR ART

A number of hose rewinding assemblies in the prior art utilize electric motors to drive a reel for retracting an elongate member such as a cord or hose. Examples are disclosed as follows:

U.S. Pat. No. 4,832,074 discloses an automatic hose rewinding device having an alternating current (AC) motor driven reel. The desired amount of hose is pulled out of the enclosure manually for use. After use a button is pushed once and the hose is completely retracted until a device on the end of the hose strikes a bar to disengage the AC motor. The design of the device does not allow small increments of the hose to be retracted. If the operator wishes to use a smaller amount of hose, the entire hose must be retracted and the desired amount of hose must be manually pulled out again. Additionally, the use of alternating current reduces portability of the device and increases the risk of electrical shock.

U.S. Pat. No. 4,513,772 discloses an automatic hose winding apparatus having an intermeshing, non-slipping clutch. The desired amount of hose is pulled out of the enclosure manually for use. For retraction, the operator must manually lock the intermeshing clutch mechanism in place. When the hose is completely retracted a device on the end of the hose strikes a lever to disengage the intermeshing clutch. The design of the device allows increments of the hose to be retracted, however, the operator must manually disengage the clutch before any amount of hose can be manually payed out. The apparatus makes no disclosure or suggestion of a protective enclosure or a disengaging hose guide.

U.S. Pat. No. 5,495,995 discloses a motor driven hose reel assembly. The device interconnects two sensors and a motor to monitor the quantity of hose manually pulled from the reel. By pulling on the hose manually, the hose is rewound in an amount less than that necessary to completely rewind the hose. Because the device is operated in a retraction direction when the hose is pulled, the design requires the operator to overcome the pulling force of the device to extend hose from the machine.

U.S. Pat. No. 4,012,002 discloses a coupling mechanism for use in conjunction with a hose reel to automatically and selectively engage or disengage the reel and motorized drive train. The coupling utilizes a sliding spring pin on the drive train which is designed to automatically engage one of a series of cooperating stop lugs on the reel to transmit the driving power of the motor to the rotatable reel. The spring pin can be manually locked in a disengaged position to allow the hose reel to freewheel. When the spring pin is engaged the device operates in direct drive from the motor.

U.S. Pat. No. 6,149,096 discloses a retractable reel device especially useful for electrical cables. The device is specifically designed to allow an operator to pull out a desired amount of cable. Once the cable is paid out, the device maintains a predetermined amount of tension on the cable. Thereafter, any slack in the cable is automatically retracted by an AC motor.

Thus, what is lacking in the art is a direct current powered hose rewinding device having an infinitely adjustable torque transfer method for modulating hose retrieval. The references are further deficient in teaching the use of a rechargeable battery in combination with a direct current (DC) motor for powering the hose retrieval device. Moreover, the references are deficient in teaching an enclosure with safety interlocks that prevent the motor from being engaged when a cover is in an open position. The devices are further deficient in teaching a safety hose guide assembly that is capable of disengagement in the event that the path of the device is inadvertently blocked. The prior art devices are still yet deficient in teaching a motorized hose rewinding device with manual override, allowing the hose to be retracted manually as well as by motor. Even further, the prior art devices are deficient in teaching a device which includes a telescoping handle and a pair of rearwardly mounted wheels for easy transport of the device.

BRIEF DESCRIPTION OF THE INVENTION

The present invention provides an improved direct current powered hose rewinding device having an enclosure including a telescoping handle and a pair of rotatably mounted wheels to provide portability. Additional features include various embodiments of infinitely variable torque transfer assemblies which cooperate with the direct current motor for power-assisted hose retrieval.

The apparatus includes a motorized rotatable spool carried and contained within an enclosure. The rotatable spool includes a hub and a pair of flanges at opposing ends of the hub, and is configured for storage, motorized take-up, and manual pay-out of the flexible hose. Power for the motorized spool is supplied through a control assembly that includes a rechargeable battery, a main power switch, and at least one safety interlock. The safety interlock(s) are incorporated into the enclosure and prevent motorized operation of the spool when the enclosure is opened.

The enclosure has left and right side wall panels, front and rear wall panels extending between the left and right wall panels, and a cover. The enclosure is configured for receiving a rotatable spool for storing a length of flexible hose within the enclosure.

The cover pivots about a pair of hinges that mount the cover to the enclosure for movement between a closed position and an open position. The hinge arrangement includes hinge pin bosses extending upwardly from a top edge of the rear panel, wherein a hinge pin extends from each of the hinge pin bosses about laterally and in axial alignment with respect to each other. The cover is formed having a depending lip and a pair of pockets that are integrally formed into the rear wall of the depending lip for cooperation with each respective hinge boss and pin. Preferably, the pins are formed as fluted cylindrical elements extending from the bosses, axially aligned to one another to facilitate rotational movement.

When the cover is rotated into the open position, a safety interlock switch assembly prevents motorized operation of the hose spool. When the cover is rotated into the closed position, an engagement pin extending from the underside of the cover cooperates with the safety interlock switch to allow motorized operation of the spool.

To facilitate take-up and pay-out of the hose with the cover closed, the front wall panel includes a cut-out portion extending downward from the top edge thereof adjacent to the junction with the cover. In this arrangement, when the cover is closed, the cut-out accommodates traversing a portion of the flexible hose therethrough.

In one embodiment a reciprocating hose guide assembly is linked to the spool. When the spool is rotated, the reciprocating hose guide will move back and forth across the spool to uniformly and smoothly wrap the hose on the spool to provide a compact storage configuration.

In a further embodiment, the reciprocating hose guide can be released from its double-helix lead-screw in the event that its path becomes blocked, such as by debris or when a hand or arm is mistakenly placed in the opening. Alternatively, the hose guide may be manually disengaged to facilitate easy hose pay-out, and can thereafter be repositioned before being manually re-engaged.

A sliding seal fluid inlet joint permits the hose outlet joint to rotate with the hose spool without disconnecting the hose. This arrangement permits rotating the spool without twisting or torquing internal components, while maintaining sealed fluid communication between the water supply and the hose.

For rotational operation the spool is provided with a winding means capable of manual rotational movement of the spool in relation to the enclosure and an electrically energized power assist means for selective and operative engagement of the winding means. The winding means is illustrated as a hand crank extending through the enclosure and connected to the spool at about its axis of rotation. The power assist means is illustrated as a DC powered motor mounted within the enclosure and connected to the hose spool via a torque transfer assembly. In some embodiments the torque transfer assembly utilizes a dynamic clutch assembly to transfer torque from the motor to rotate the torque transfer assembly thereby rotating the spool. In other embodiments the clutch assembly may regulate torque supplied to the spool via a foot pedal operated clutch assembly. In one embodiment the foot operated cantilever forces an idler friction wheel into engagement with a drive friction wheel and a spool friction wheel to selectively couple and decouple the DC motor to and from the spool to modulate the pulling force and rotational speed of the hose spool. When the foot pedal is depressed the main power switch of the control assembly supplies current from the battery to start the DC motor and the idler friction wheel is forced into engagement to provide the desired speed and/or force required for hose retrieval. Release of the pedal stops the motor and allows hose to be freely pulled from the spool as desired.

In an alternative embodiment the foot operated cantilever forces an idler gear into engagement with a drive gear and a spool gear to selectively couple and decouple the DC motor to and from the spool to modulate the pulling force and rotational speed of the hose spool. When the foot pedal is depressed the main power switch of the control assembly supplies current from the battery to start the DC motor and the idler gear is forced into engagement to provide the desired speed and/or force required for hose retrieval. Release of the pedal stops the motor and allows hose to be freely pulled from the spool as desired. The device may also include at least one idler gear to adjust torque and rotational speed of the hose spool with respect to the motor.

Because motors often operate at relatively high RPM, the DC motor may include an internal gear train coupled between the armature of the DC motor and the DC motor output shaft. The internal gear train is capable of reducing RPM output and increasing motor torque.

Power for the control assembly is provided by a removable, replaceable, and rechargeable battery assembly conveniently stored within its own closed compartment in the enclosure. Connection to the battery is made via a unique clip-on connector that also provides an integrated battery charging jack. The clip-on connector is constructed and arranged to prevent the clip from being incorrectly connected to the battery and the assembly requires directional installation into the enclosure for electrical connection to the control assembly. The integrated charging jack in the clip-on connector allows convenient battery recharging without disconnecting the clip from the battery. In this manner the battery can be safely and easily removed, recharged, and/or reinstalled into the enclosure without danger of incorrect connection.

Therefore, it is an objective of the present invention to provide a motorized hose rewinding apparatus wherein the speed and/or force of hose retrieval is modulated by virtue of an infinitely adjustable torque transfer assembly.

It is a further objective of the present invention to provide a motorized hose rewinding apparatus that is constructed to utilize a DC power source.

It is still a further objective of the present invention to provide a motorized hose rewinding apparatus having a removable and rechargeable power source.

Yet another objective of the present invention is to provide a battery operated rechargeable motorized hose rewinding apparatus capable of protecting the hose during storage from direct contact with the elements.

Still another objective of the present invention is to provide a motorized hose rewinding apparatus that is aesthetically appealing to consumers.

Still yet another objective of the present invention is to provide a motorized hose rewinding apparatus that includes an enclosure having safety interlocks to prevent motorized operation when the enclosure is opened.

Still yet another objective of the present invention is to provide a hose rewinding device that provides portability by utilizing wheels and telescoping handle assembly to permit easy transport of the device.

Still yet another objective of the present invention is to provide a hose winding guide assembly that includes automatic as well as manual disengagement features.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
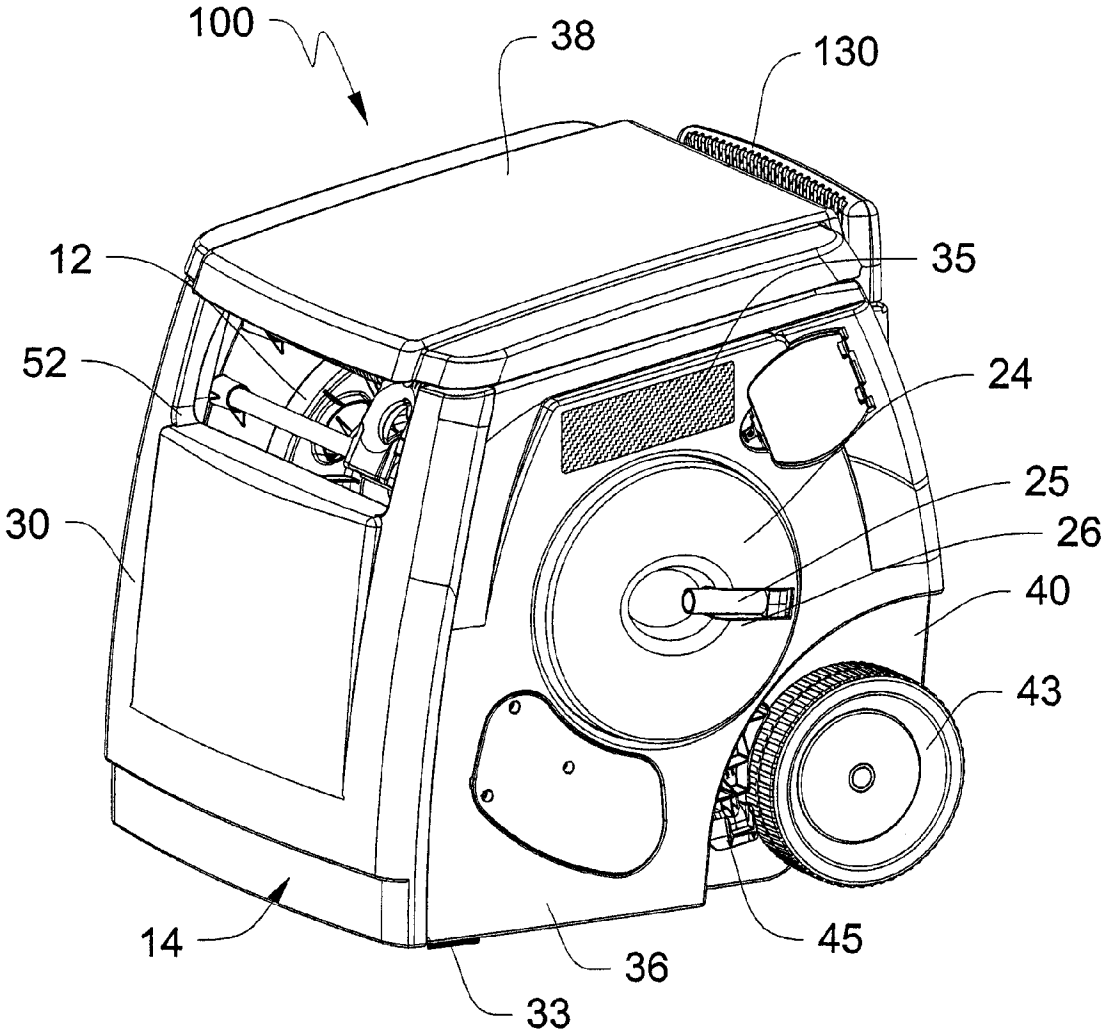
FIG. 1 is a front perspective view of the motorized hose rewinding apparatus of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
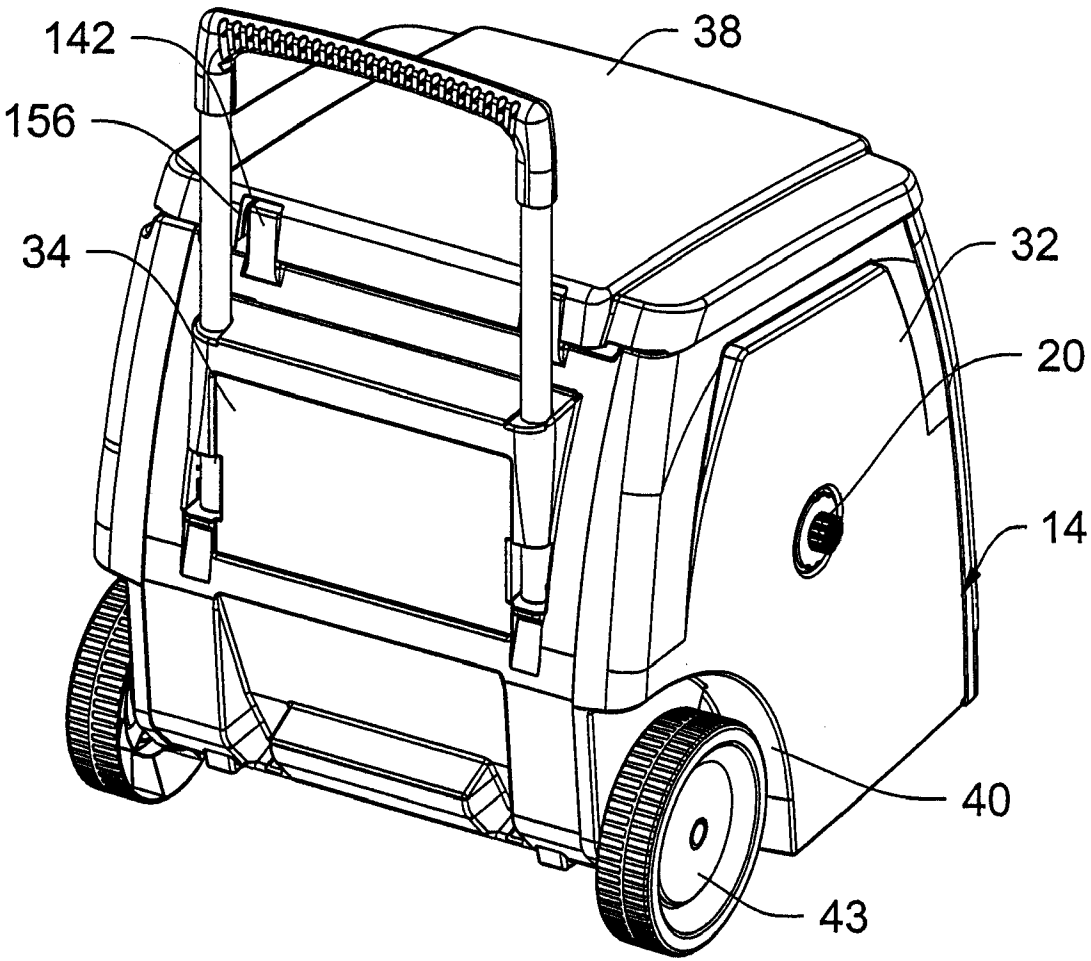
FIG. 2 is a rear perspective view of the motorized hose rewinding apparatus illustrated with the telescoping handle in an operative position.

Referring now to FIGS. 1 and 2, generally, there is shown a direct current powered hose rewinding device 100 in accordance with the principles of the present invention. The hose rewinding device 100 includes a motor driven spool 12 onto which the hose is mechanically wound or taken up, and from which the hose is manually fed out or paid out.

The enclosure 14 includes a front wall panel 30 and a rear wall panel 34, a left side wall panel 32, a right side wall panel 36, and a pivoting cover 38. Optionally, the enclosure 14 can include a bottom panel (not shown) for substantially fully enclosing the spool 12 and protecting the spool 12 and hose from the elements. The optional bottom panel is preferably constructed as a reversible member with an enhanced friction engaging first surface and a relatively smooth second surface. In this manner the bottom panel could be inserted to prevent the apparatus from skidding on hard surfaces where staking is not practical. In addition, the bottom surfaces of the left side wall panel 32 and right side wall panel 36 may be constructed with optional rubber pads 33 to further engage hard surfaces. As will be apparent from the drawings, the front, rear and side panels 30-36, and the cover 38 enclose the spool 12 such that the spool is substantially not visible from outside of the enclosure 14 when the cover 38 is closed.

In a first embodiment the front panel 30 of enclosure 14 includes a cut-out portion 52 extending downwardly from the top lip thereof. The cut-out portion 52 can be elongated and is suitably sized to accommodate a standard size garden hose so that the hose can be paid-out from or taken-up onto the spool 12 without lifting the cover 38. That is, the hose can freely move through the cut-out opening 52 without opening the cover 38.

In a most preferred embodiment the front panel 30 of enclosure 14 includes an elongated cut-out portion 52 extending downwardly from a top lip thereof. The cut-out portion 52 is sized to accommodate a reciprocating hose guide assembly 50 (FIG. 3A) so that the hose can be uniformly and smoothly wrapped on the spool 12 to provide a compact storage configuration or easily paid-out from the spool 12 without lifting the cover 38.

The enclosure 14 preferably includes a pair of wheel recesses 40 extending inwardly into the right side panel 36 and left side panel 32 for housing the rotatably mounted wheel assemblies 43. The wheel recesses 40 are generally positioned at a lower rear portion of the side panels and each includes a centrally located wheel assembly hub 212 and aperture 41 (FIG. 4) for accepting the wheel 200 and axle portion of a wheel assembly 43.

Figure 3A:
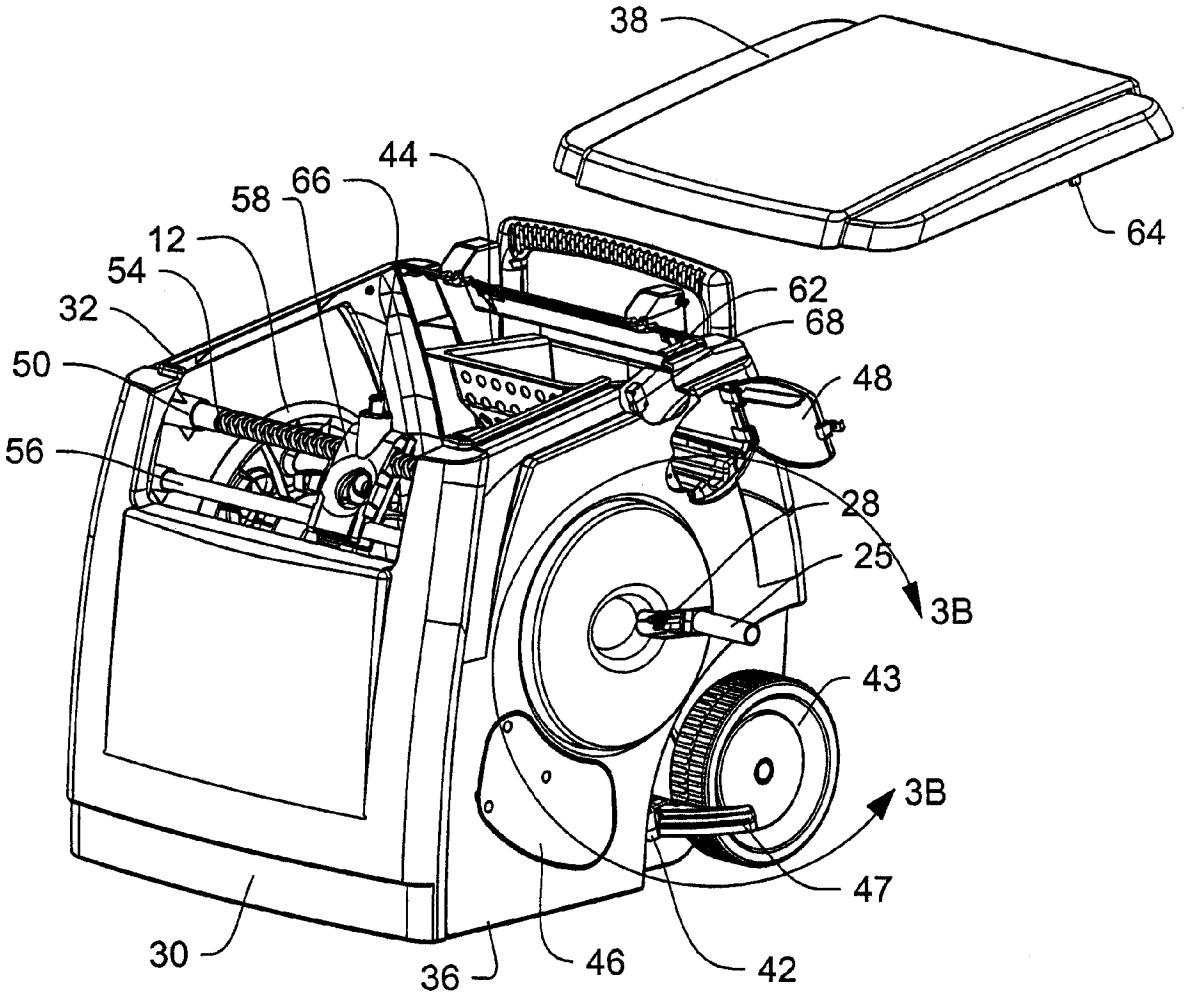
FIG. 3A is a front partially exploded perspective view of the instant invention illustrating the hand crank and the foot pedal in their respective open positions.
Figure 3B:
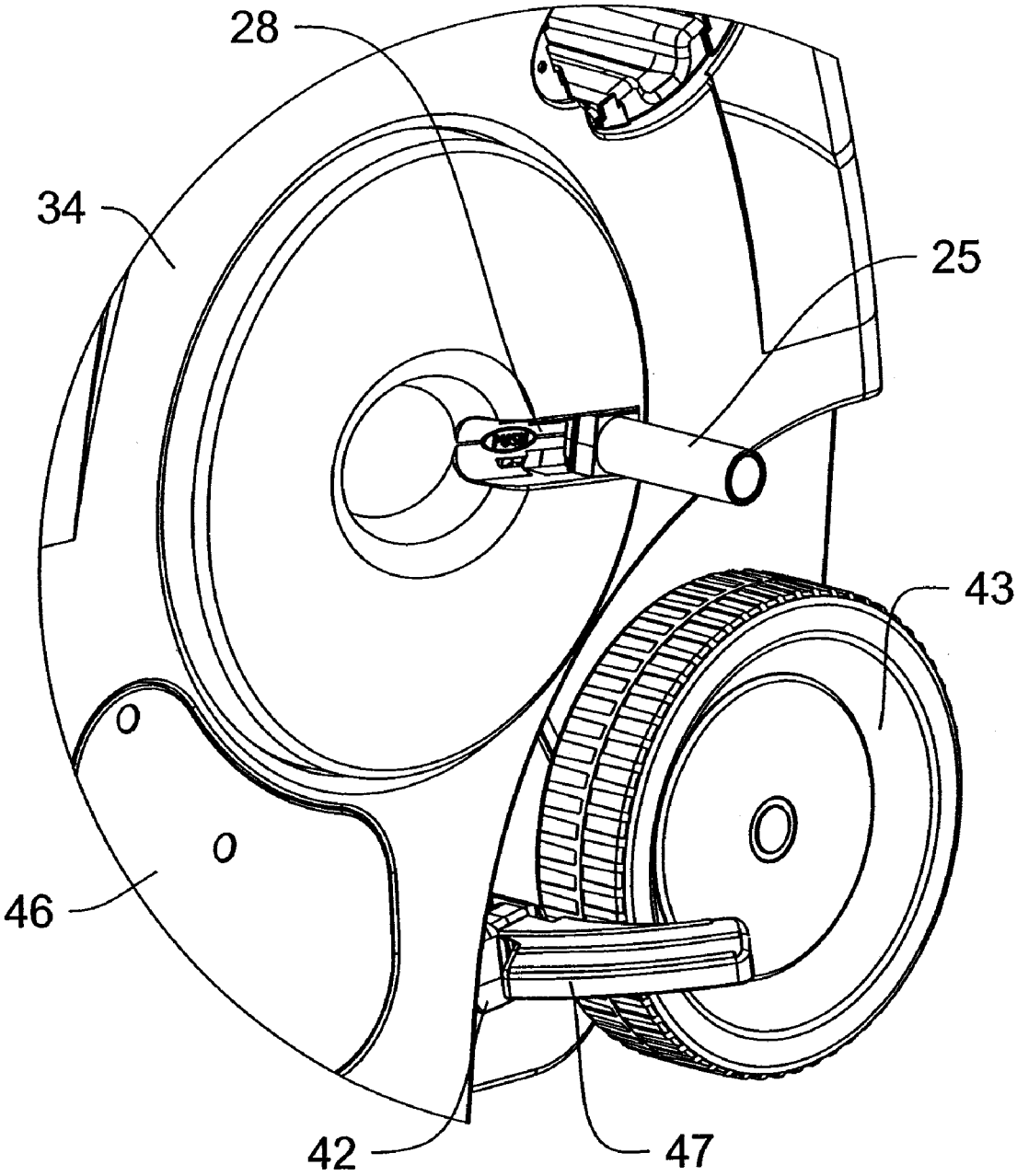
FIG. 3B is a partial view taken along lines 1-1 of FIG. 3.

In a most preferred embodiment, the right side panel wheel recess 40 includes a foot pedal aperture 45. The foot pedal aperture is adapted to allow the second end 42 of the cantilever 110 (FIG. 6A) to extend therethrough. The foot pedal 47 extends outwardly with respect to the side panel 36, as shown in FIGS. 3A and 3B, when the foot pedal 47 is in an operational position and is recessed with respect to the outermost portion of the side panel 36, as shown in FIG. 1, when the foot pedal 47 is in a storage position. This construction prevents inadvertent operation of the foot pedal 47 and permits compact storage of the device.

A manual override winding crank 24 is external of the enclosure 14 and extends through a side wall for connection to the spool 12, preferably on an end opposite to that of the in-tube 20 (FIG. 2), to facilitate manual take-up of the hose. The crank 24 includes a folding handle 25 capable of folding into a recess 26 formed in the crank 24. The handle releasable lock 28 (FIG. 3A) in the crank 24 cooperates with detents in the handle 25 to permit the handle 25 to be locked into either a position parallel to the crank or a position perpendicular to the crank. Locking the handle 25 in the parallel position permits the spool to rotate without the danger of the rotating handle hitting or snagging objects or persons within its path and also permits a compact enclosure.

Now referring to FIGS. 3A and 3B, the motorized hose rewinding apparatus 100 is illustrated partially exploded. The battery cover 48 and handle 25 are illustrated in their respective open positions and the foot pedal 47 in its respective operative position.

Incorporated into the enclosure 14 is a lockout assembly 62 that prevents the direct current motor 98 (FIG. 6A) from operating when the cover 38 is in the open position. The lockout assembly 62 is illustrated as, but not limited to, an engagement pin 64 cooperating with a normally open micro-switch 68. Other devices well known in the art suitable for sensing an open cover and locking out electrical devices when the cover is open may be substituted for the pin and switch assembly illustrated herein. Such devices may include but should not be limited to micro-switches, proximity switches, mercury switches, mechanical switches, optical switches and the like.

Also visible is the reciprocating hose guide assembly 50 and the basket member 44. The reciprocating hose guide assembly 50 contains a double helix lead-screw 54, guide rod 56, and carriage 58. The reciprocating hose guide assembly 50 is linked via gear-train 96 (FIG. 6A) to the hose spool 12 so that when the hose spool 12 is rotated, the double helix lead-screw 54 rotates at a desired ratio with respect to the hose spool 12. The lead-screw 54 is journaled for rotation between side members 32 and 36 and is substantially parallel to the central hub portion of spool 12. The lead-screw 54 engages the carriage 58 via follower 66, allowing the carriage 58 to move back and forth across the lead-screw 54 and the guide rod 56 when engaged during both manual and motorized operation. The follower 66 can be manually disengaged from the lead-screw 54 to permit easy pay-out of hose or repositioning of the carriage 58. Operation of the hose guide assembly 50 permits hose to be uniformly and smoothly wrapped on the spool 12 to provide a compact storage configuration. Optionally the follower 66 may include a disengagement feature that permits the carriage 58 to release from the lead-screw 54 in the event that the carriage 58 is obstructed during motorized or manual hose rewinding.

Figure 4:
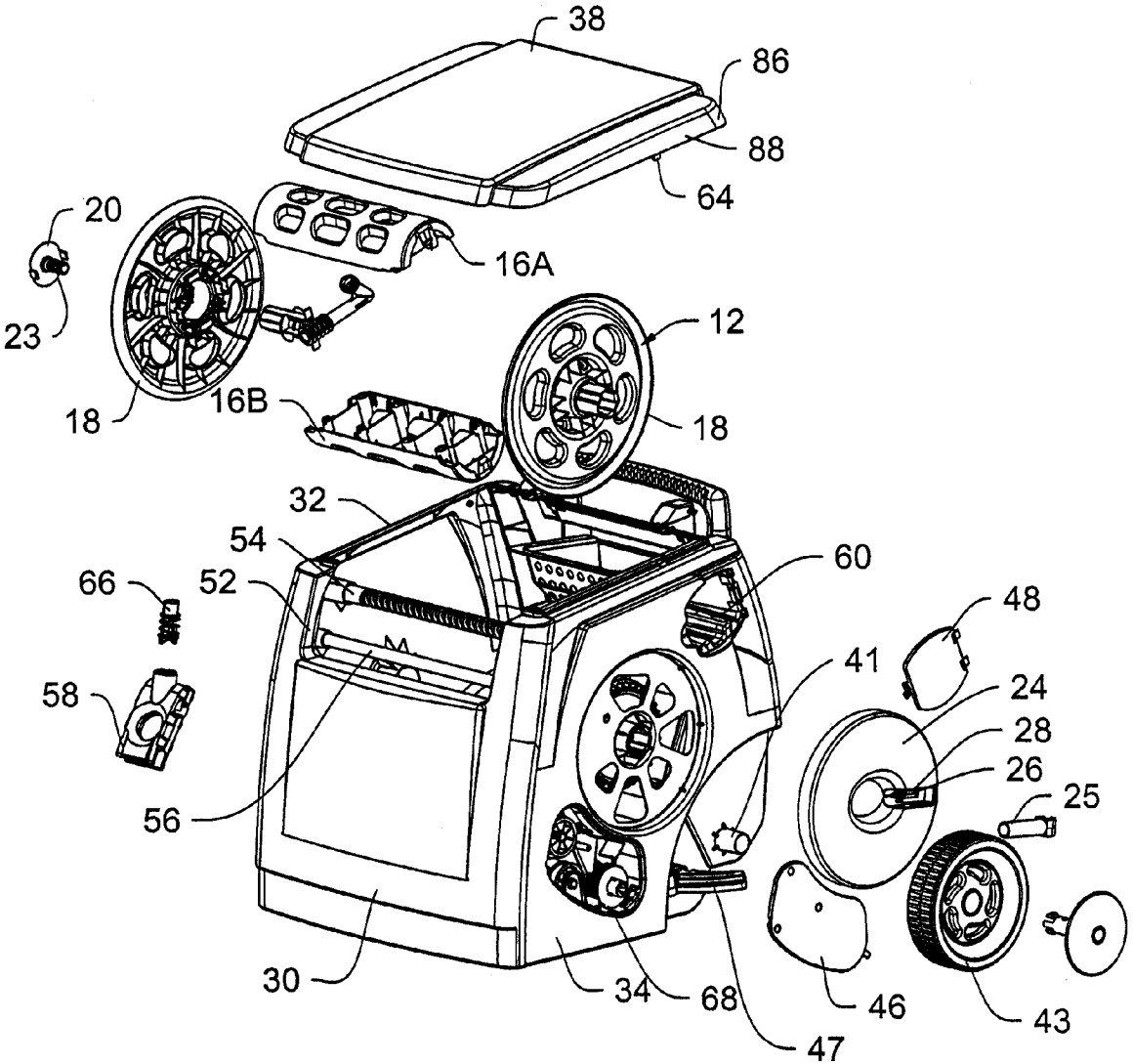
FIG. 4 is an partially exploded perspective view of the of the instant invention.

Referring to FIG. 4, the spool 12 is supported by and rotatably mounted within the enclosure 14. The spool 12 includes a central hub 16 constructed of two mating halves 16A and 16B and a pair of radially extending flanges 18 that are configured to accommodate a length of the flexible hose wrapped around the hub 16 between the flanges 18. In a typical arrangement, the hose spool 12 can store upward of 150 feet of ⅝ inch garden hose.

Those skilled in the art will recognize that the hose spool 12 includes a water inlet port or in-tube 20 and an outlet port or out-tube 22. The in-tube 20 is mounted to the enclosure 14 at about the axis of rotation of the spool 12. The in-tube 20 is connected to the out-tube 22 by a sliding seal arrangement 23 which will be recognized by those skilled in the art. This arrangement permits the in-tube 20 to remain fixed to the enclosure 14, while the out-tube 22 rotates with the spool 12. In this configuration, the in-tube 20 and out-tube 22 remain in fluid communication with one another. This arrangement permits rotating the spool 12 without twisting or torquing internal components, while maintaining sealed fluid communication between the water supply and the hose.

Also visible is one embodiment of the torque transfer assembly 68 having the structural transfer cover 46 removed. The transfer cover 46 cooperates with the right side panel 36 to provide structural support to the torque transfer assembly.

Still referring to FIG. 4, the wheel assemblies 43 are shown. Each of the wheel assemblies include a wheel 200 and an axle member 202. The axle member 202 includes an axle stub 204. On a first end of the axle stub is a plurality of integrally formed spring clips 206. The spring clips are constructed and arranged to cooperate with the wheel assembly aperture 41 for push in interlocking installation of the wheel assemblies 43. On a second opposite end of the axle stub 204 is an integrally formed thrust plate 208. In operation, the wheel aperture 210 is placed over hub 212 and the axle member 202 is slid into wheel assembly aperture 41. In this manner the axle stub extends through a central portion of said wheel for interlocking engagement with the rear panel and the thrust plate abuts the wheel to rotatably secure the wheel to the enclosure.

Figure 5:
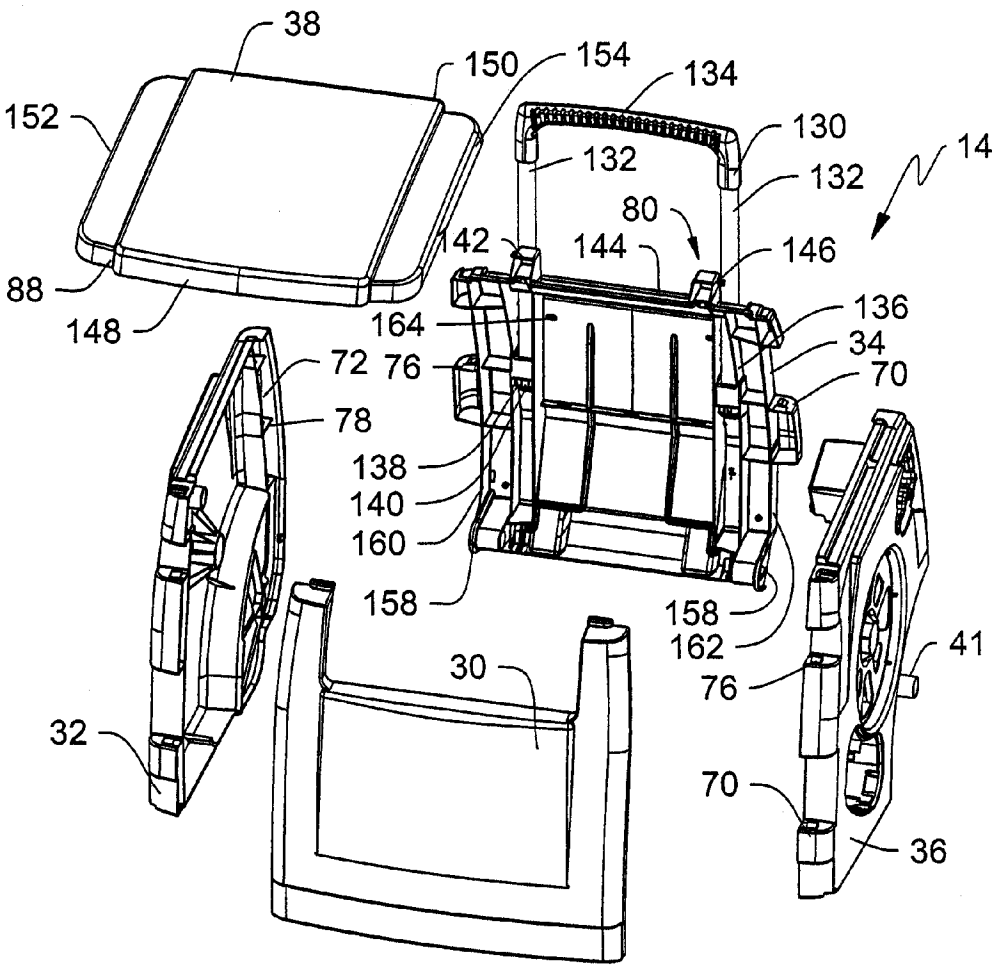
FIG. 5 is a partially exploded perspective view of the enclosure of the instant invention.

Referring to FIG. 5, an exploded view of the enclosure is shown 14. The panels 30-38 are preferably molded components formed from high strength polymeric (plastic) material, such as polystyrene or the like. The panels 30-38 are most preferably configured such that the front and rear panels 30, 34 have contoured posts 70 that insert into recesses or channels 72 formed integrally and extending vertically along the front and rear edges of each side wall panel 32 and 36. The contoured projections 70 include ramped surfaces or snap-type elements 76 that engage openings 78 in the channels 72 to lock the panels to one another.

Advantageously, this configuration permits ready assembly of the enclosure 14 with a minimum number of tools, and involves a minimum number of parts.

The rear panel 34 includes a telescoping handle assembly 130. The telescoping handle assembly 130 is moveable between a storage position, as illustrated in FIG. 1, wherein the handle is substantially the same height as the enclosure 14 and an in-use position, as illustrated in FIG. 2, wherein the handle extends above the overall height of the enclosure. The telescoping handle 130 assembly preferably includes a pair of spaced apart telescoping members 132 and a handle member 134 extending substantially horizontally between the telescoping members. The rear panel member 34 includes a pair of integrally formed channels 136 constructed and arranged to guide the telescoping handle assembly 130 during movement between the storage and the in-use positions. The telescoping members 132 each include at least one detent 138 constructed and arranged to cooperate with at least one protrusion 140 integrally formed into the telescoping member channels 136 to secure the handle assembly 130 in at least one predetermined position.

The cover or top panel 38 is fitted to the panels 30-36 using a hinge arrangement indicated generally at 80. The hinge arrangement 80 permits pivoting or rotating the cover 38 between the closed position and an open position. The cover 38 is configured so that when opened and maintained in the open position, use of the motorized spool is locked out via lockout assembly 62 (FIG. 3A).

The hinge arrangement 80 includes a pair of integrally formed hinge pin bosses 142 extending upwardly from the top edge 144 of the rear panel 34, each boss including a laterally extending and axially aligned hinge pin 146. In a present embodiment, the cover 38 has a depending lip 88 extending around the perimeter of the cover. The depending lip includes a front 148, a rear 150, a left 152 and a right surface 154, the rear surface having a pair of pockets 156 (FIG. 2) constructed and arranged to cooperate with a respective hinge pin 146 and boss 142. Each of the pockets 156 are configured to permit rotational movement of the cover 38 about the pins 146 for upward rotational movement of the cover.

The rear panel 34 also includes a pair of wheel assembly receivers 158 each constructed and arranged to cooperate with the axle portion of a wheel assembly 43 (FIG. 1). In the preferred embodiment one of the wheel assembly receivers 158 is integrally formed into the left edge 160 of the rear panel and one of the wheel assembly receivers 158 is integrally formed into the right edge 162 of the rear panel. The wheel assembly receivers 158 are positioned to align with the left and right side panel wheel assembly hubs 212 and apertures 41.

The rear panel 34 further includes a pair of integrally formed hooks 164 constructed and arranged to cooperate with a basket member 44 (FIG. 3A), wherein the basket member 44 is constructed and arranged to fit within the enclosure 14 while permitting hose storage about spool 12. The basket member provides storage space within the enclosure for a variety of hose accessories.

Figure 6A:
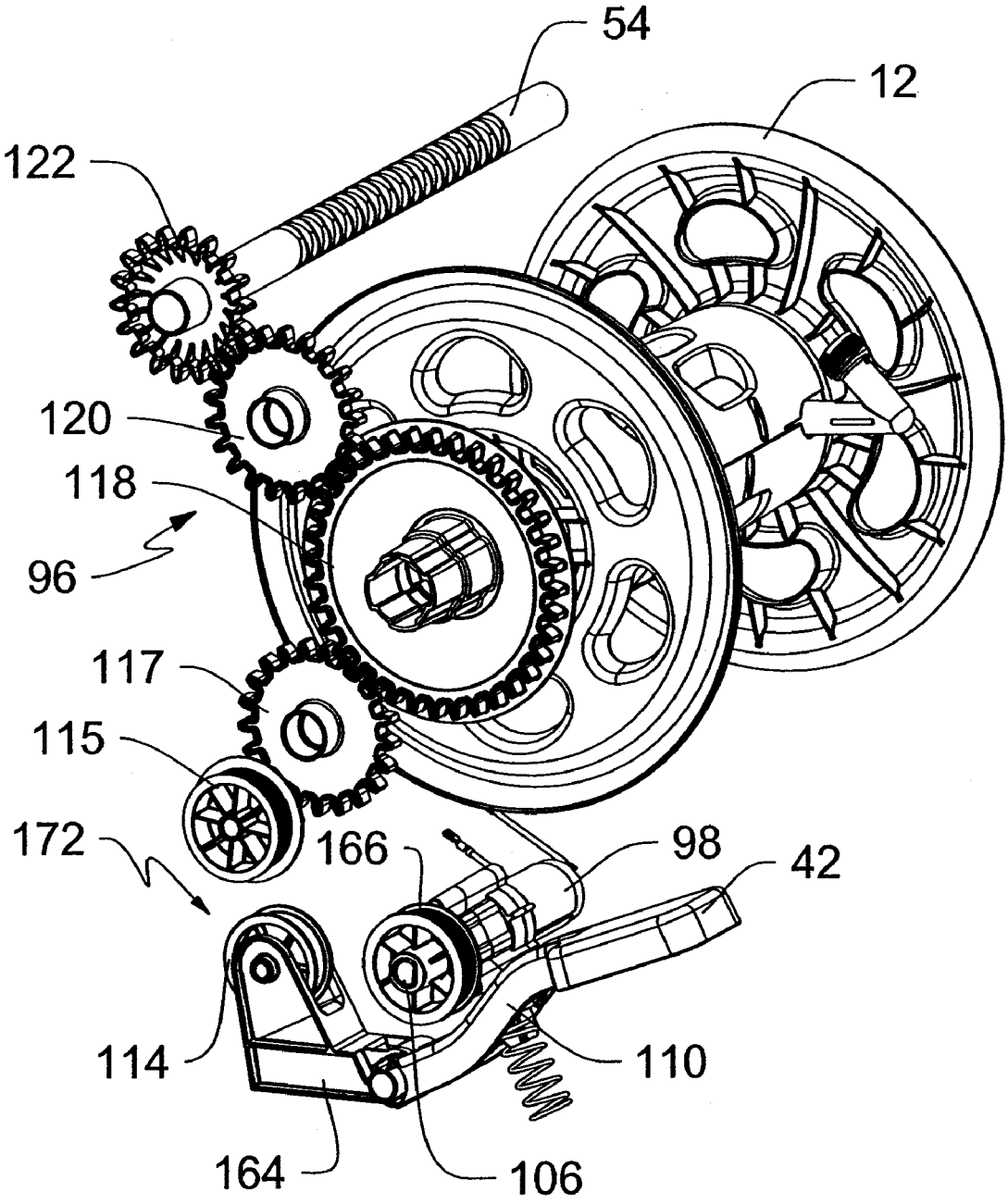
FIG. 6A is a partial view of the instant invention illustrated with the enclosure omitted for clarity.
Figure 6B:
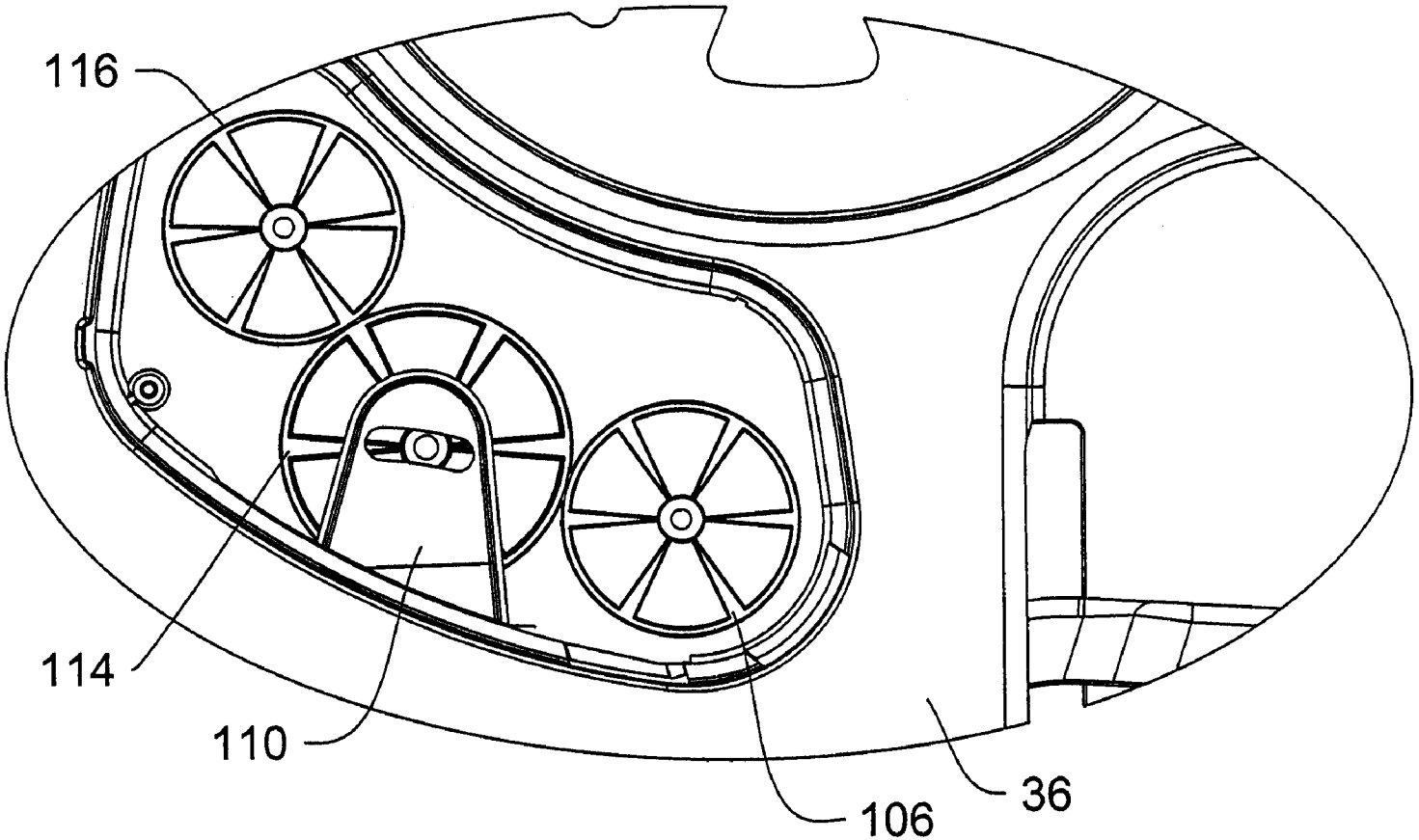
FIG. 6B is a partial view of one embodiment of the variable torque transfer assembly.
Figure 6C:
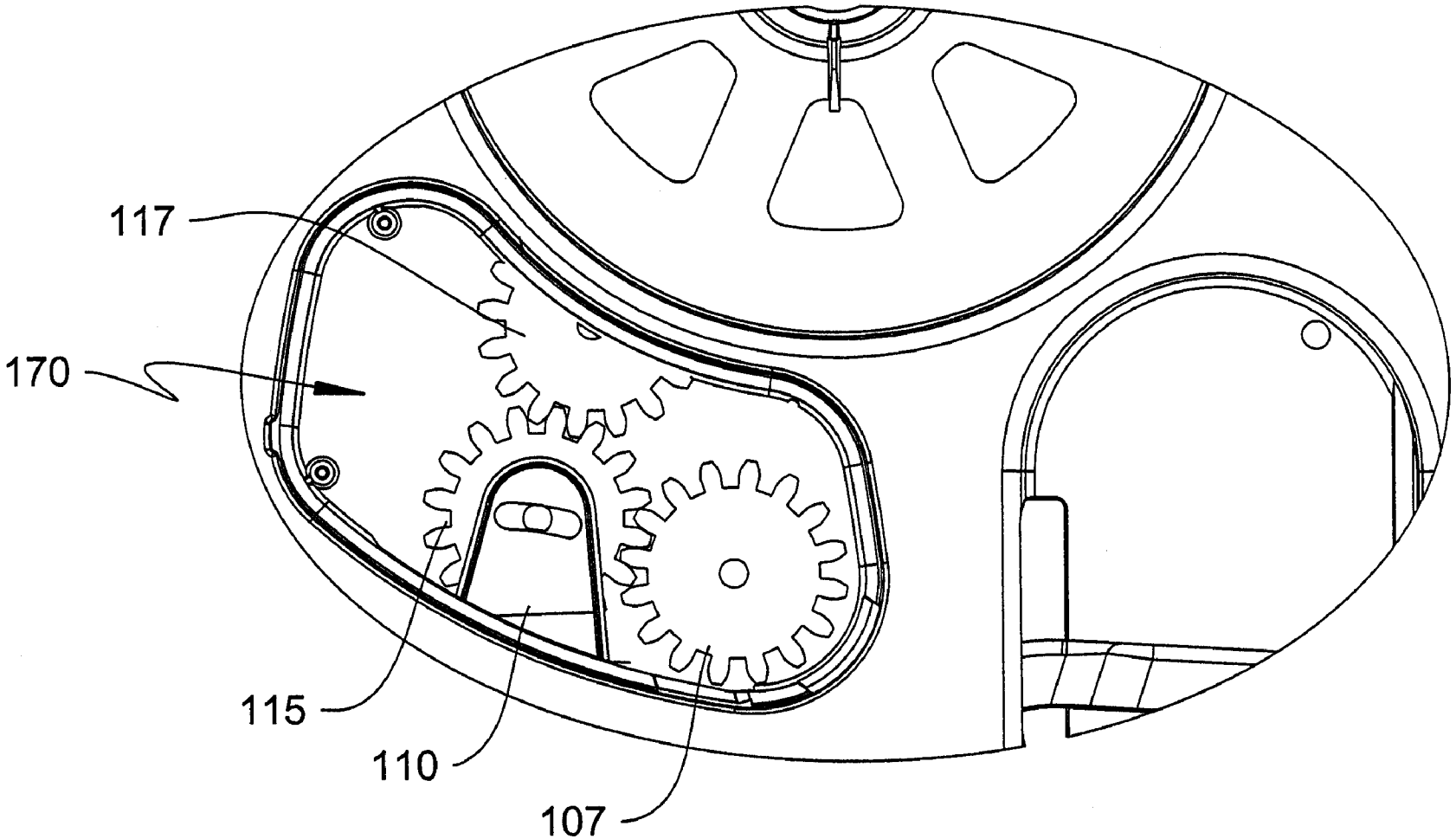
FIG. 6C is a partial view of one embodiment of the variable torque transfer assembly.

Referring to FIGS. 6A, 6B and 6C, one embodiment of the torque transfer assembly 172 and hose guide gear-train 96 are shown. For motorized operation, the motorized hose rewinding apparatus 100 is provided with a DC powered motor 98 connected to the torque transfer assembly 172 which is connected to the spool 12. In these embodiments the torque transfer assembly is illustrated as but not limited to a friction drive assembly 168 (FIG. 6B) and a gear drive assembly 170 (FIG. 6C). In the friction drive assembly 168 a friction drive wheel 106 is rotatably secured within the enclosure and suitably coupled to the direct current motor output shaft 166. At least one friction idler wheel 114 is constructed and arranged for selective engagement with the friction drive wheel 106 and rotatable responsive to rotation of the friction drive wheel 106. At least one driven friction idler wheel 116 is positioned for engagement the friction idler wheel 114 wherein the friction idler wheel 116 is rotatable responsive to rotation of the idler wheel 114. A respective spool friction wheel 118 is secured to the hub 16 of spool 12 to be rotatable therewith, the spool friction wheel 118 being larger in diameter than the friction drive wheel 106. The spool friction wheel 118 is rotatable responsive to the friction idler wheels 114 and 116, thereby enabling the direct current motor 98 to rotate the spool 12 at a rotational speed less than the rotational speed of the friction drive wheel 106.

In the drive gear assembly 170 a drive gear 107 is rotatably secured within the enclosure and suitably coupled to the direct current motor output shaft 166. At least one idler gear 115 is constructed and arranged for selective engagement with the respective drive gear 107 and at least one driven idler gear 117 wherein the idler gears 115 and 117 are rotatable responsive to rotation of the drive gear 107. A spool gear 118 is secured to the hub 16 of spool 12 to be rotatable therewith. The spool gear 118 larger in diameter than the drive gear 107. The spool gear rotatable responsive to the idler gears 115 and 117, thereby enabling the direct current motor 98 to rotate the spool 12 at a rotational speed less than the rotational speed of the drive gear 107.

The preferred embodiment includes a second assembly pivotably mounted within the enclosure illustrated as a cantilever 110 having a first end 164, preferably including the idler wheel 114 or idler gear 115, and a second end 42 including a pivotally mounted foot pedal 47. The construction and arrangement of the second assembly allows the pulling force and rotational speed of the motorized spool 12 to be regulated. For example, when the foot pedal 47 is depressed the current from the battery 132 (FIG. 12) flows through a fuse and is allowed to start the DC motor 98. The idler gear 115/friction wheel 114 is forced into engagement with the drive gear 107/friction wheel 106 and any driven idler gears 117/friction wheels 116 respectively to rotate the spoo1 gear/friction wheel 118 to provide the desired rotational speed and/or force for hose retrieval. It should be appreciated that the clutch assembly may regulate torque supplied to the spool via the foot operated cantilever to modulate pulling force and rotational speed of the hose spool. Release of the pedal 47 stops the motor 98 and releases engagement of the idler gear 115/friction wheel 114, and allows the spool 12 to be freely rotated. In this manner, the operator of the present invention can easily regulate the rewinding of hose around the spool 12 as well as allow hose to be manually paid out.

When the pedal 47 is depressed the motor rotates the spool through the action of the torque transfer assembly 68. That is, the motor 98 rotates the drive gear 107/friction wheel 106, the idler gear 115/friction wheel 114 respectively operatively engages and rotates driven idler gears 117/friction wheels 116, that rotates the spool gear/friction wheel 118 to complete the power-assisted rotation of the spool 12. The hose winding guide lead-screw 54 is caused to rotate through the action of gears 118, 120, and 122. That is, when spool 12 is rotated by motor 98 or by handle 25, the spool 12 and spool gear 118 rotates, which causes the idler gear 120 to rotate, which causes lead screw 54 to also rotate.

Figure 7A:
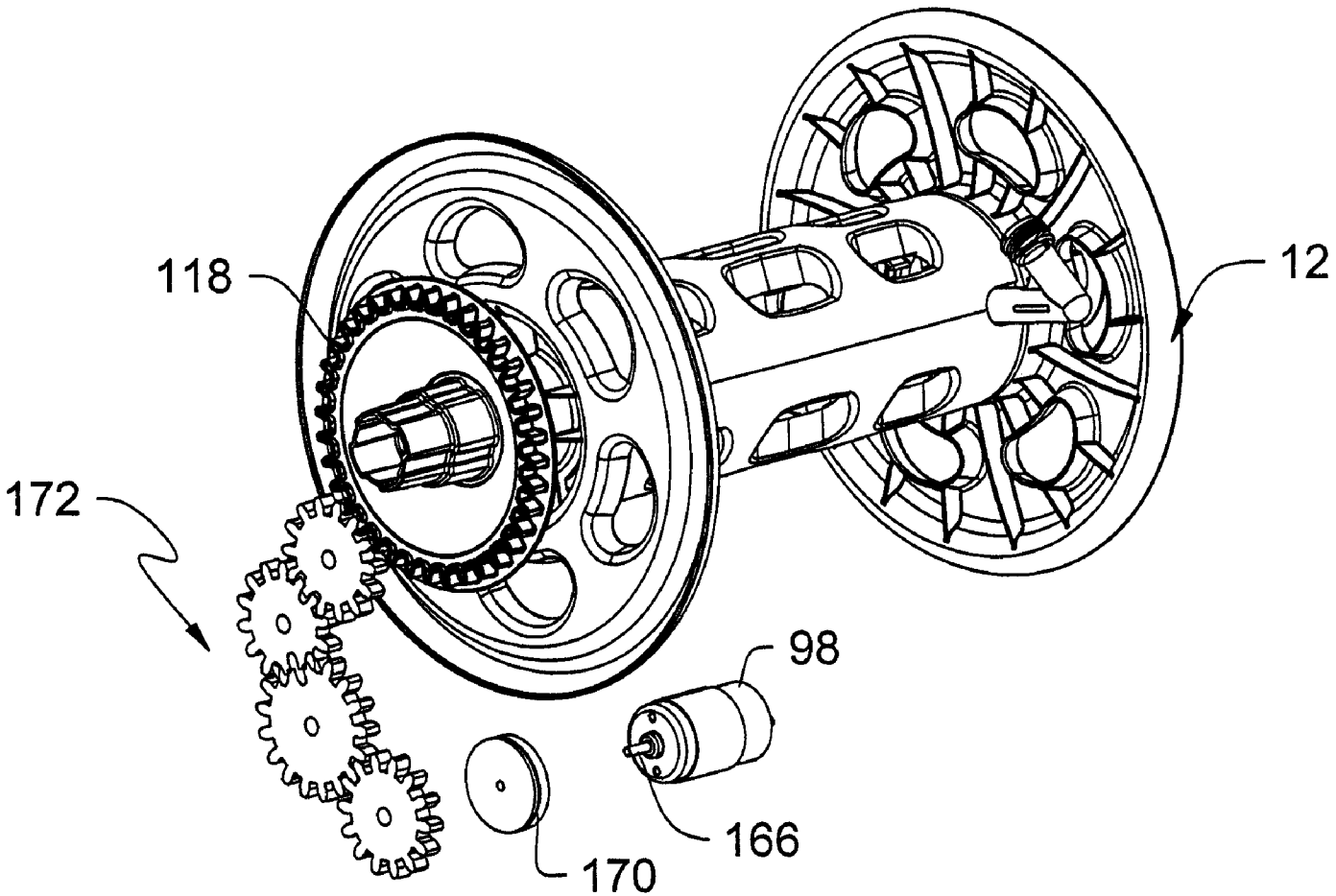
FIG. 7A is a partially exploded perspective view of one embodiment of the variable torque transfer assembly.
Figure 7B:
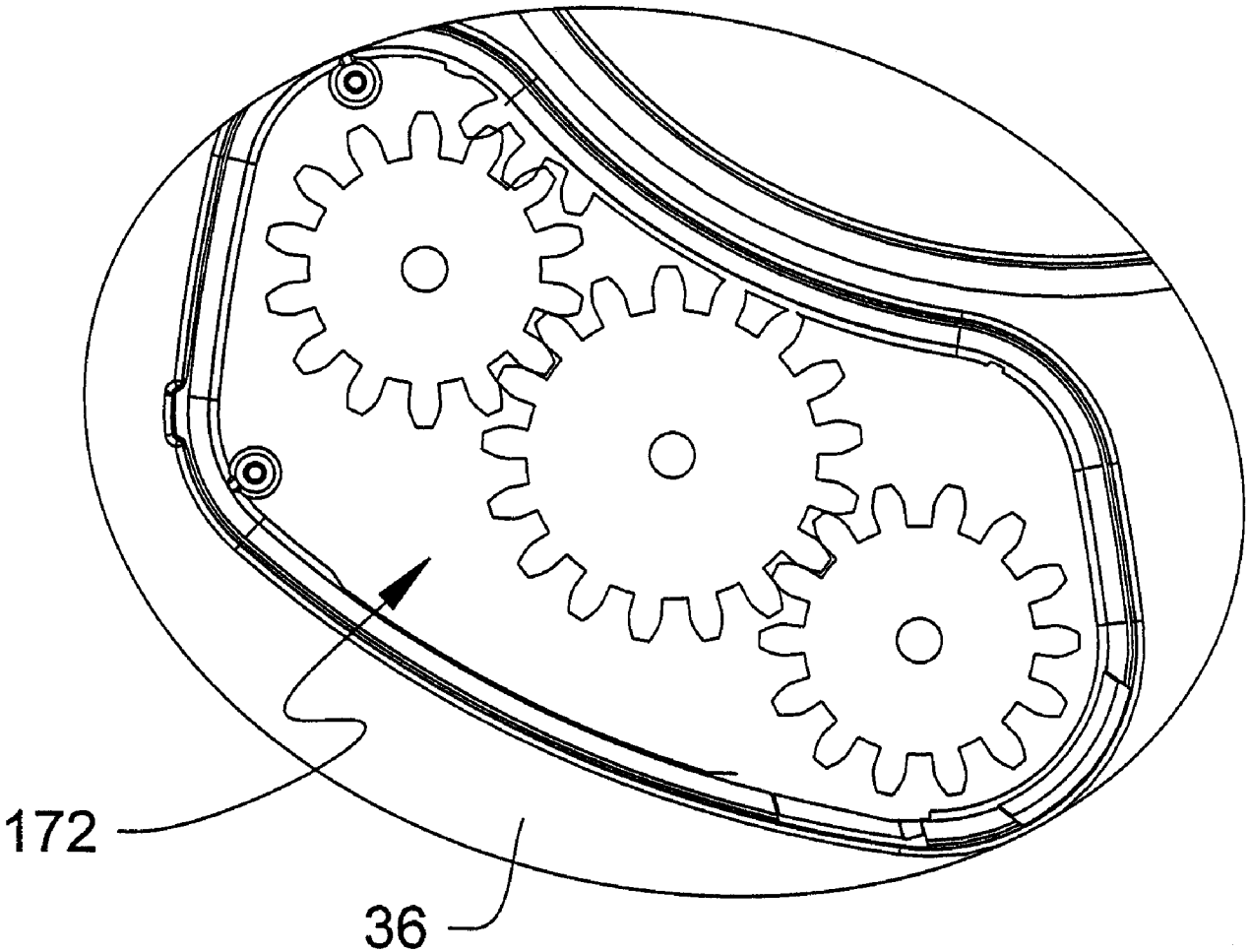
FIG. 7B is a partial view of one embodiment of the torque transfer assembly.

Referring to FIGS. 7A and 7B an alternative embodiment of the power assist means is illustrated. In this embodiment a clutch assembly 170 is suitably coupled to the direct current motor output shaft 166 for transferring rotational torque from the direct current motor 98 to the torque transfer assembly 172. The clutch assembly 170 is of a type well known in the art that may include, but should not be limited to plate type clutches and couplings, cone type clutches and couplings, slip type clutches and couplings, spring applied clutches and couplings, centrifugal clutches and couplings, fluid clutches and couplings, Sprag type clutches and couplings and electromagnetic type clutches and couplings. The clutch assembly 170 may also be constructed and arranged to limit the amount of rotational torque that may be transferred from the direct current motor 98 to the torque transfer assembly 172.

The clutch assembly 170 generally includes a first mating surface and a second mating surface, wherein the first mating surface and the second mating surface are constructed and arranged to engage with each other upon rotation of said direct current motor output shaft to cause rotation of the torque transfer assembly 172 and the spool 12. In a preferred embodiment the first and second surfaces of the clutch assembly 170 utilize friction to selectively rotate the torque transfer assembly 172 and thereby the spool 12. In a most preferred embodiment a cantilever arrangement 110 having a foot pedal 47 may be utilized to operatively control the frictional engagement between the first and second surfaces to allow an operator to control hose retrieval speed and force. In this manner springs, pressurized fluids, mechanical advantage or suitable combinations thereof may be utilized to engage the clutch assembly for selective rotation of the spool 12.

Figure 8:
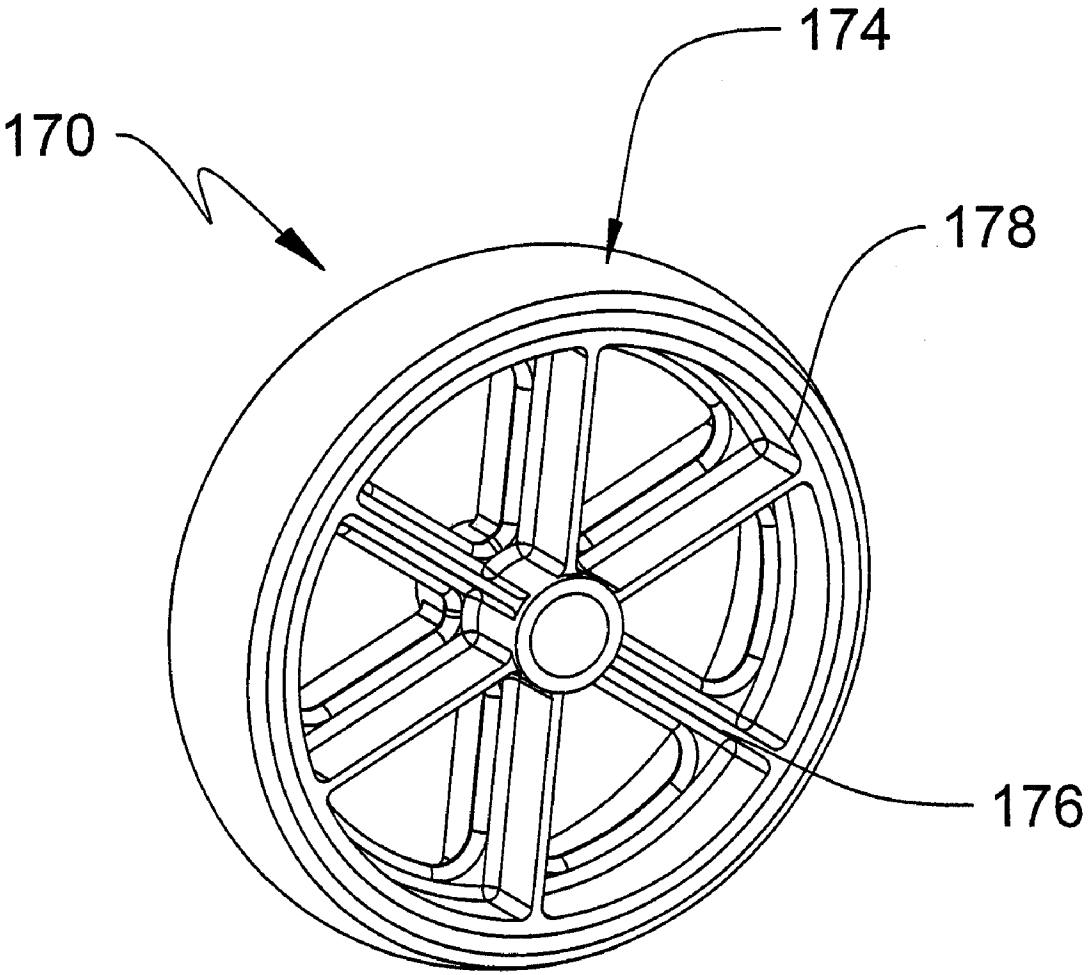
FIG. 8 is a perspective view illustrating a centrifugal type clutch assembly.

Referring to FIG. 8, the clutch assembly 170 is illustrated in a non-limiting embodiment as a centrifugal clutch 174. The centrifugal clutch 174 includes a first surface 176 and a second surface 178 wherein the first and second surfaces frictionally engage each other upon the direct current motor output shaft 166 achieving a predetermined number of revolutions per minute.

Figure 9:
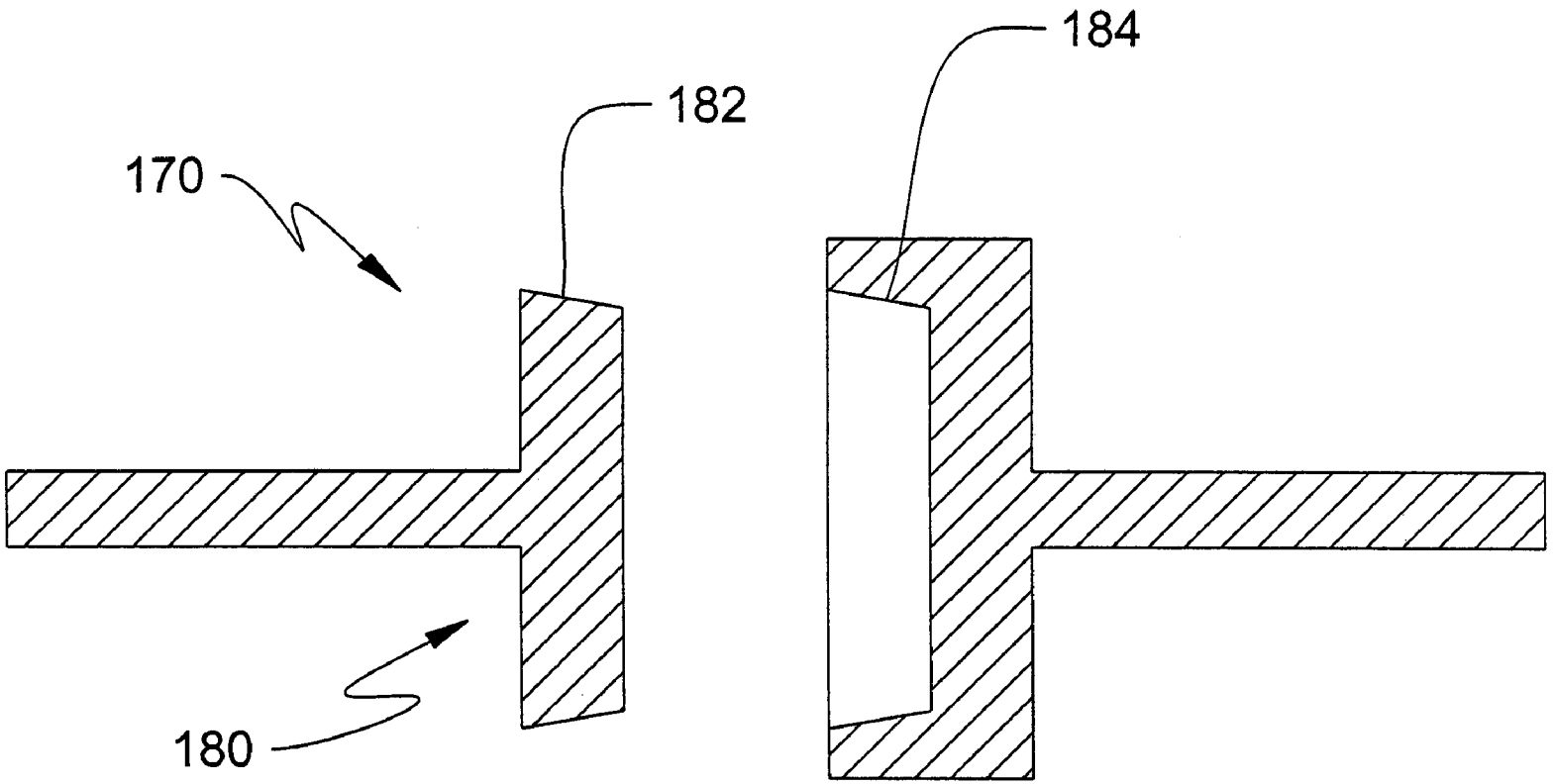
FIG. 9 is a side view illustrating a cone type clutch assembly.

Referring to FIG. 9, the clutch assembly 170 is illustrated in a non-limiting embodiment as a cone clutch 180. The cone clutch includes a first frustoconical surface 182 and a second generally frustoconically shaped bore surface 184, wherein the first and the second surfaces are axially aligned and wherein the first and second mating surfaces utilize friction to selectively rotate the torque transfer assembly 172. The cone clutch assembly 170 may utilize springs, cantilevers, pressurized fluids or the like well known in the art to control the torque output transferred from the clutch assembly to the torque transfer assembly.

Figure 10:
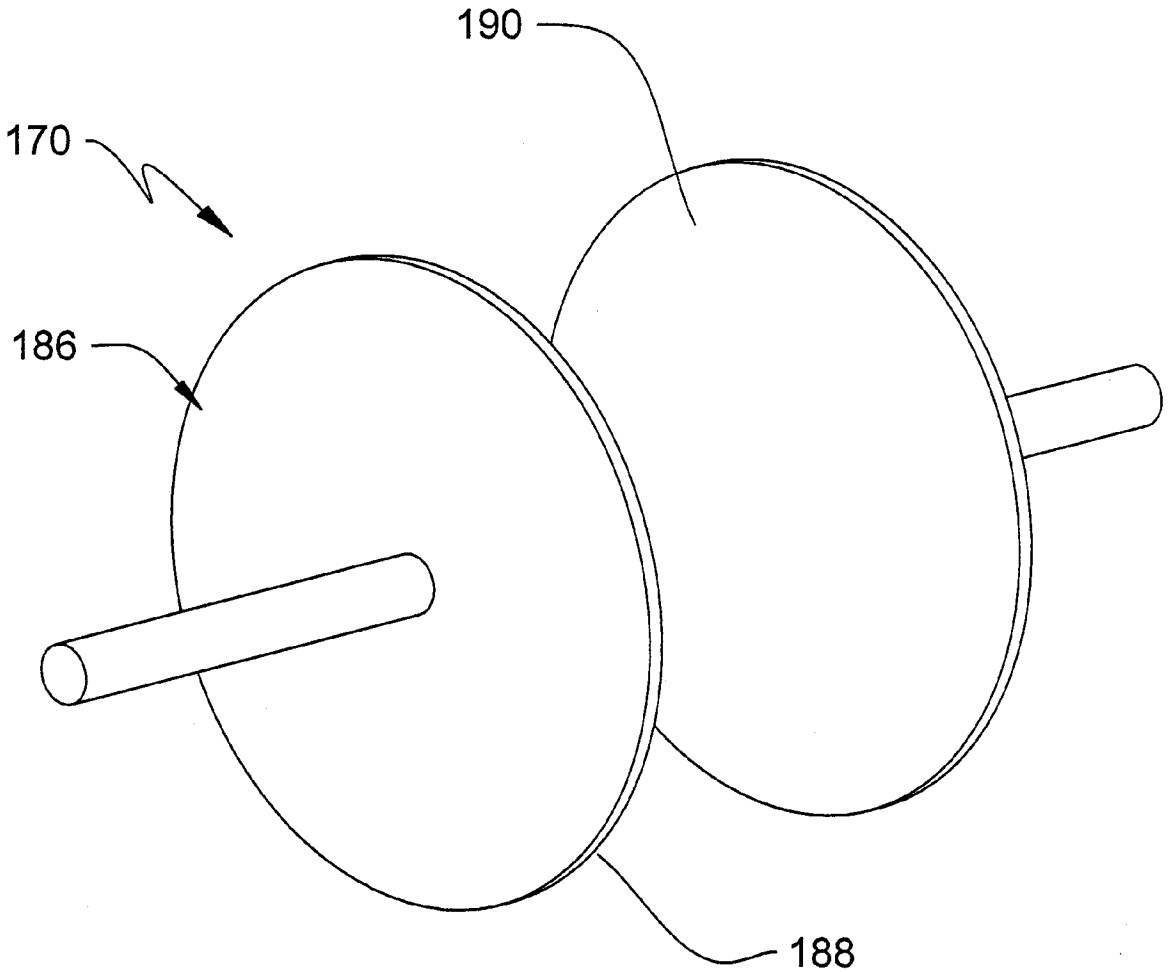
FIG. 10 is a perspective view illustrating a plate type clutch assembly.

Referring to FIG. 10, a non-limiting embodiment of a plate clutch 186 is illustrated. The plate clutch includes a first generally disc shaped surface 188 and a second generally disc shaped surface 190, wherein the first and the second surfaces are axially aligned and wherein the first and second mating surfaces utilize friction to selectively rotate the torque transfer assembly 172. The plate clutch 186 may utilize springs, pressurized fluids, cantilevers or the like, all well known in the art, to control the torque output transferred from the clutch assembly 170 to the torque transfer assembly.

Figure 11:
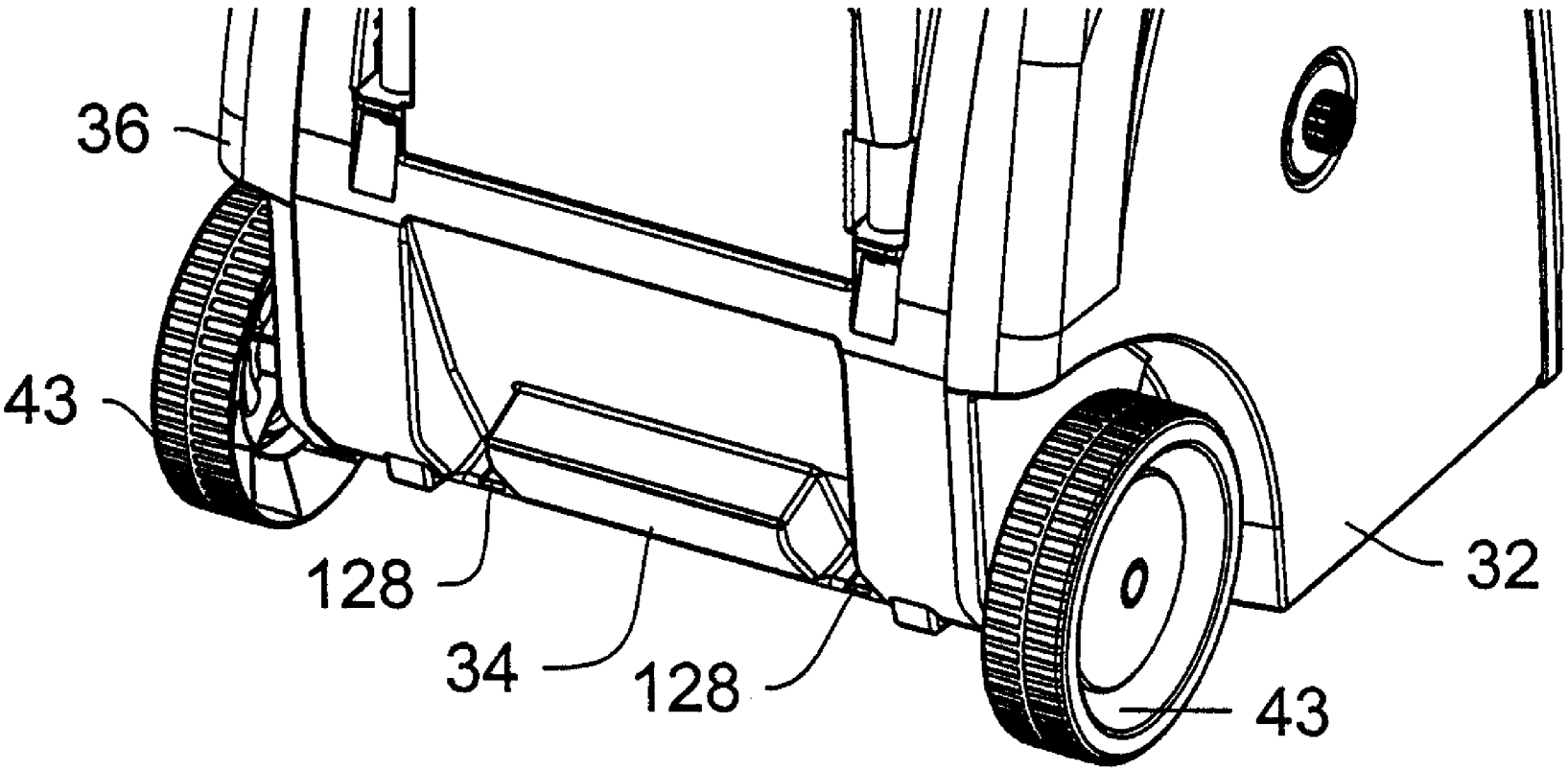
FIG. 11 is a partial rear view illustrating the recessed anchoring apertures.

Referring to FIG. 11, the lower portion of rear panel 34 of enclosure 14 is shown. The rear panel contains at least one and preferably two recessed anchoring apertures 128. The recessed apertures 128 allow the enclosure to be securely attached to a desired surface with an attachment means such as lag bolts, spikes or metal stakes, to prevent unwanted movement of the apparatus during motorized/manual rewinding or manual pay-out of hose. It should be appreciated that recessing the anchoring apertures increases safety by eliminating objects extending outwardly from the enclosure.

Figure 12:
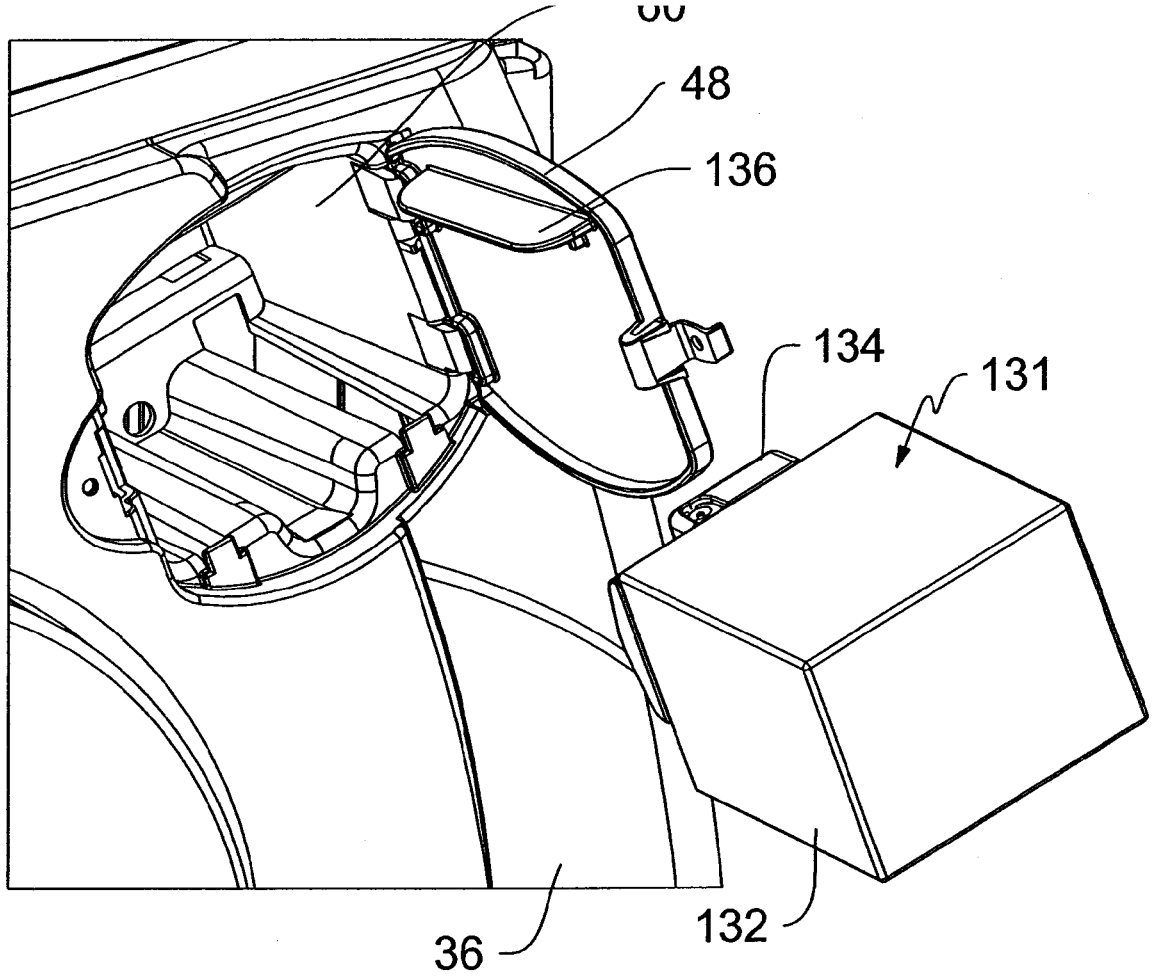
FIG. 12 is a partial exploded view illustrating the battery assembly.

Referring to FIG. 12, the battery compartment and the DC power supply are shown. The battery compartment 60 is generally located in the upper rear corner of the right panel 36. The battery compartment GO is constructed and arranged in a manner that allows the battery assembly 131 to be directionally slid into the compartment for electrical cooperation. That is, there is no need to connect wires to the battery assembly to operate the device. The battery compartment contains a pair of electrical contacts (not shown), positioned in a manner so that electrical contact is made only if the battery assembly is correctly installed.

Figure 14:
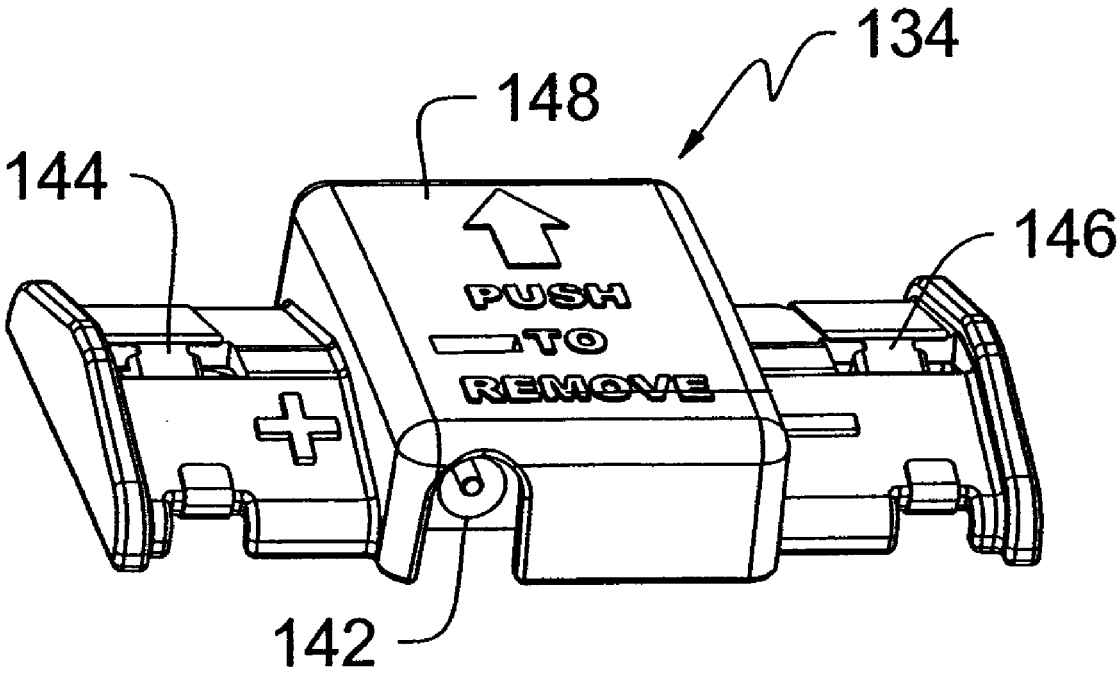
FIG. 14 is a perspective view of the battery clip assembly.

The battery compartment 60 is provided with a hinged battery cover door 48 having a latch arrangement for releasably engaging side panel 36. Formed integrally to the inside of the battery cover door is a vertical battery hold down 136. When the door 48 is latched in the closed position the battery compartment electrical contacts and the battery assembly electrical contacts 144, 146 (FIG. 14) are maintained in a cooperating relationship. In this manner, the battery assembly 131 is removable and replaceable without the need to attach wiring.

Figure 13:
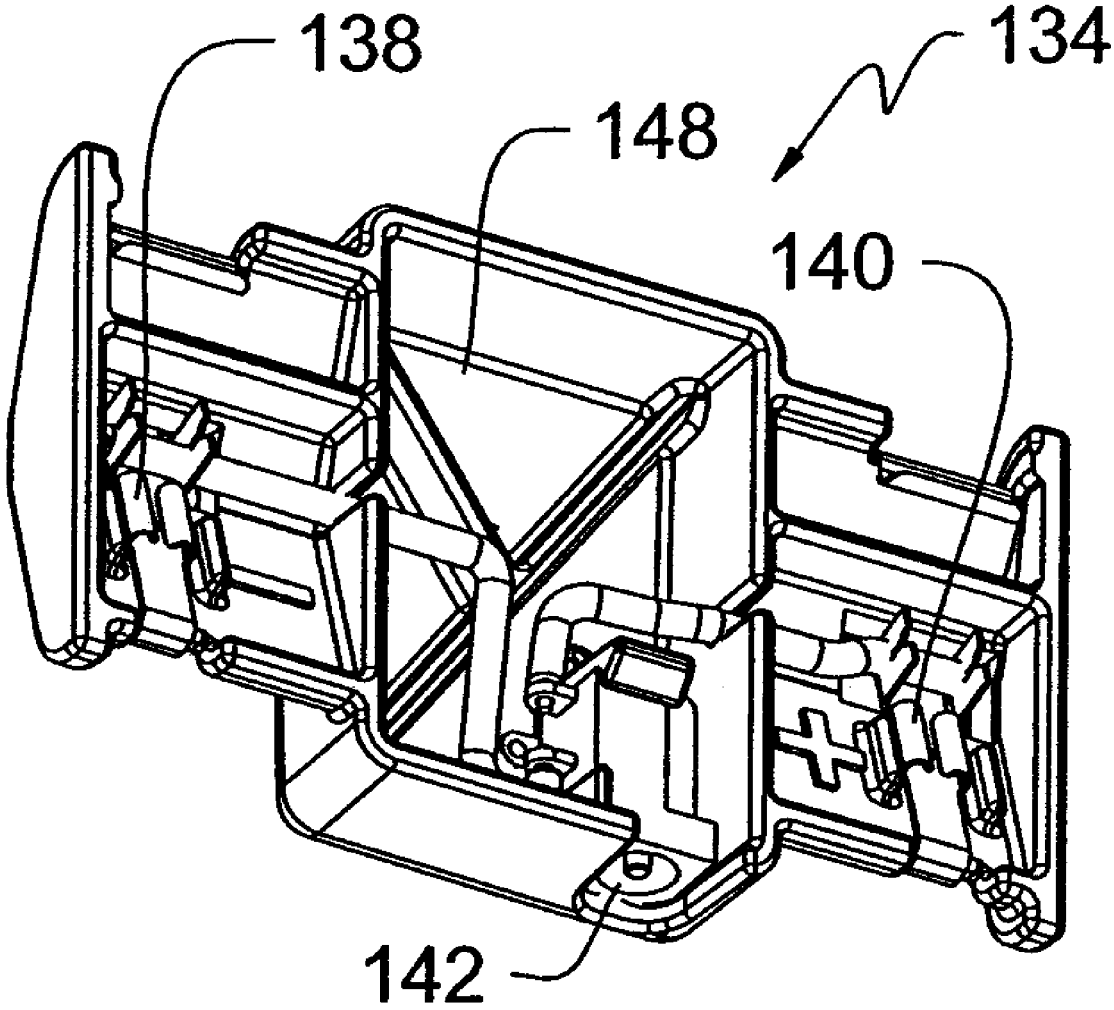
FIG. 13 is a perspective view of the underside of the clip assembly utilized in the present invention.

Referring to FIGS. 12 and 13, a perspective view of the underside (FIG. 13) and the topside (FIG. 14) of the battery clip 134 is shown. The battery clip 134 contains two conductive battery quick connectors 138, 140 and a recharging jack 142 removably attached to a non-conductive cap 148. The conductive quick connectors 138, 140 are constructed and arranged to slidably connect to battery terminals (not shown) and conduct current from the battery 132 to contacts 144 and 146 (FIG. 13) located in a juxtaposed position to the upper surface of the nonconductive cap 148. The contacts 144, 146 are positioned on the non-conductive cap 148 to allow operation of the motorized hose rewinding apparatus 100 only if the battery assembly 131 is inserted into the battery compartment 60 in the correct directional manner. The recharging jack 142 allows the battery to be recharged without disconnecting the clip 134 from the battery 132. In this manner the battery clip can be easily attached to and removed from the battery, allowing the assembly to be removable, replaceable, and rechargeable.

Figure 15:
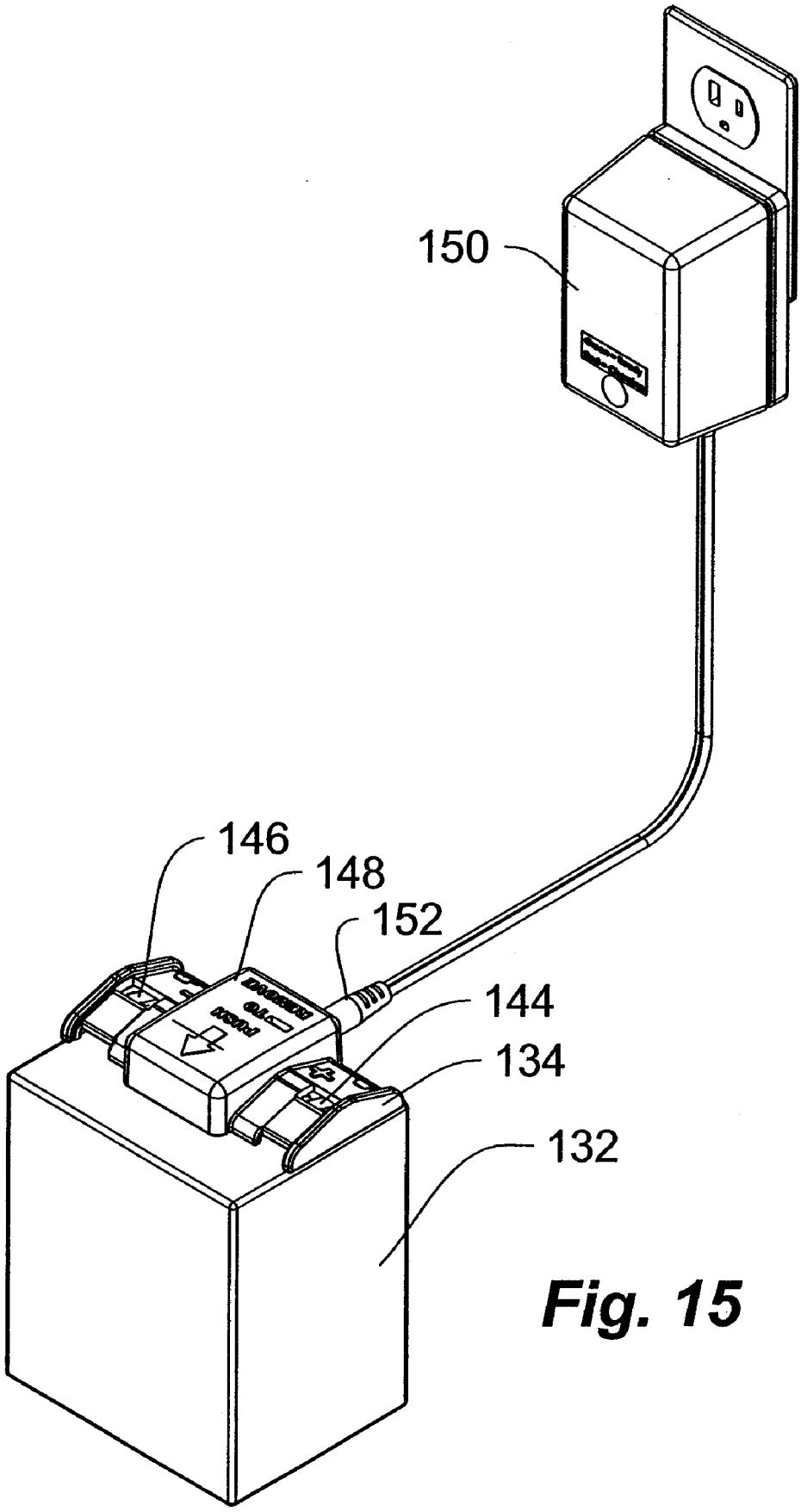
FIG. 15 is a pictorial view of the battery and charger assembly.

Referring to FIG. 15, a perspective view of the battery assembly 131 cooperating with the battery charging means illustrated herein as battery charger 150. The battery charger 150 is constructed and arranged to utilize a plug 152 that mates with a charging jack 142 for charging the battery 132. Battery chargers that utilize household current to recharge low voltage DC batteries are well known in the art and a detailed description will therefore be omitted. In a preferred but non-limiting embodiment, the instant invention may utilize solar cells 35 (FIG. 1) as a means to recharge the battery 132. The solar cells 35 are incorporated into one or more of the various panels of the enclosure and are in electrical communication, e.g. wired, to transfer the energy generated to the battery for storage. Solar cells that utilize bright sunlight to recharge low voltage DC batteries are well known in the art and a detailed description will therefore be omitted.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A direct current powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a winding means constructed and arranged to provide infinite rotational movement of said spool in relation to said enclosure;

a direct current energized power-assist means constructed and arranged to selectively and operatively engage said winding means, said power-assist means including a direct current motor, said direct current motor including an armature and an output shaft, wherein rotation of said armature causes rotation of said output shaft;

a torque transfer assembly operatively coupled to said direct current motor output shaft and said winding means for selective driving thereof to cause rotation of said spool, said torque transfer assembly including a drive gear rotatably secured within said enclosure and suitably coupled to said direct current motor output shaft, a spool gear secured to said hub of said spool to be rotatable therewith, said spool gear being larger in diameter than said drive gear, at least one idler gear constructed and arranged for selective intermeshirig engagement with said drive gear and said spool gear wherein said at least one idler gear is rotatable responsive to rotation of said drive gear and said spool gear is rotatable responsive to said idler gear thereby enabling said direct current motor to rotate said spool at a rotational speed less than the rotational speed of said drive gear, a second assembly coupled to said enclosure for rotatably supporting said at least one idler gear, said second assembly including a cantilever, said cantilever being pivotally mounted within said enclosure, said cantilever having a first end and a second end, said first end of said cantilever constructed and arranged to rotatably support said at least one idler gear, said second end of said cantilever constructed and arranged to provide operator operation, wherein said manual operation selectively moves said at least one idler gear between a first position spaced apart from said drive gear and said spool gear to allow said at least one idler gear to rotate freely to allow said hose to be freely pulled from said spool, and a second position wherein said at least one idler gear engages said drive gear and said spool gear, wherein said direct current motor selectively rotates said spool to rewind said hose;

a clutch assembly suitably coupled to said direct current motor output shaft for transferring rotational torque from said direct current motor to said torque transfer assembly;

wherein manual operation of said winding means and/or power-assisted operation of said winding means provides selective rotational movement of said spool in relation to said enclosure whereby hose winding to a compact configuration is accomplished.

2. The direct current powered hose winding apparatus of claim 1 wherein said clutch assembly is a centrifugal clutch.

3. The direct current powered hose winding apparatus of claim 1 wherein said clutch assembly is a cone type clutch.

4. The direct current powered hose winding apparatus of claim 1 wherein said clutch assembly is a disk type clutch.

5. A powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a power-assist means constructed and arranged to selectively and operatively rotate said spool for retrieval of said flexible hose, said power-assist means including:

a motor, said motor including an armature and an output shaft, wherein rotation of said armature causes rotation of said output shaft;

a control assembly, said control assembly constructed and arranged to control power supplied to said motor;

an operator controlled torque transfer assembly operatively coupled to said motor output shaft and said spool for selective driving thereof to cause rotation of said spool, said torque transfer assembly constructed and arranged for variable pulling force and rotational speed of said spool, said torque transfer assembly including a clutch having a first frictional surface and a second frictional surface, whereby frictional engagement between said first and said second surfaces is operator controlled to allow operator controlled hose retrieval speed and force;

whereby operator modulated hose winding to a compact configuration is accomplished.

6. The powered hose winding apparatus of claim 5 wherein a cantilever arrangement is utilized to operatively control frictional engagement between said first and said second frictional surfaces.

7. The powered hose winding apparatus of claim 5 wherein said cantilever arrangement includes a foot pedal for operative control of said frictional engagement.

8. The powered hose winding apparatus of claim 5 wherein a manually adjustable spring arrangement is utilized to operatively control frictional engagement between said first and said second frictional surfaces.

9. The powered hose winding apparatus of claim 5 wherein said clutch is a cone type clutch.

10. The powered hose winding apparatus of claim 5 wherein said clutch is a plate type clutch.

11. The powered hose winding apparatus of claim 5 including a hand operated winding means, said hand operated winding means being constructed and arranged to provide infinite rotational movement of said spool with respect to said enclosure.

12. A powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a winding means constructed and arranged to provide infinite rotational movement of said spool in relation to said enclosure;

a electrical current energized power-assist means constructed and arranged to selectively and operatively engage said winding means, said power-assist means including an electric motor, said electric motor including an armature and an output shaft, wherein rotation of said armature causes rotation of said output shaft;

a torque transfer assembly including a friction drive wheel rotatably secured within said enclosure and suitably coupled to said electric motor output shaft;

a friction spool wheel secured to said hub of said spool to be rotatable therewith, said friction spool wheel being larger in diameter than said friction drive wheel;

a second assembly coupled to said enclosure, said second assembly including a cantilever pivotally coupled thereto, said cantilever having a first end and a second end, said first end of said cantilever constructed and arranged to rotatably support at least one friction idler wheel, said second end of said cantilever constructed and arranged to provide a lever for operator controlled movement of said friction idler wheel, whereby said friction idler wheel is constructed and arranged for operator controlled frictional engagement with said friction drive wheel and said friction spool wheel to define an operator controlled clutch assembly for transferring rotational torque from said electric motor to said torque transfer assembly;

a control assembly, said control assembly constructed and arranged to control power supplied to said electric motor;

wherein manual operation of said winding means and/or power-assisted operation provides selective rotational movement of said spool in relation to said enclosure whereby hose winding to a compact configuration is accomplished.

13. The hose winding apparatus in accordance with claim 12, wherein operation of said cantilever further operates a main power switch, wherein electrical connection is made between said electric motor and an electrical power source during operation of said lever and power is disconnected between said electric motor and said electrical power source when said lever is not operated.

14. The hose winding apparatus in accordance with claim 12, wherein said second end of said cantilever includes a foot pedal pivotally mounted thereto, said foot pedal pivotally mounted for movement between a operational position and a storage position, wherein said foot pedal is substantially axially aligned with said cantilever in said operational position and wherein said foot pedal is substantially perpendicular with respect to said cantilever in said storage position.

15. A direct current powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a winding means constructed and arranged to provide infinite rotational movement of said spool in relation to said enclosure, said winding means including a crank releasably insertable through one of said enclosure side wall panels providing a direct coupling to said spool allowing rotation thereof, said crank including a handle pivotally connected thereto, said handle securable in a parallel position with respect to said crank and perpendicular position with respect to said crank, said crank including a resilient locking tab carrying a pawl and said handle including locking detents constructed and arranged to cooperate with said pawl to lock said handle in said parallel position and said perpendicular position;

a direct current energized power-assist means constructed and arranged to selectively and operatively engage said winding means, said power-assist means including a direct current motor, said direct current motor including an armature and an output shaft, wherein rotation of said armature causes rotation of said output shaft;

a torque transfer assembly operatively coupled to said direct current motor output shaft and said winding means for selective driving thereof to cause rotation of said spool;

a control assembly, said control assembly constructed and arranged to control power supplied to said direct current motor; and a clutch assembly suitably coupled to said direct current motor output shaft for transferring rotational torque from said direct current motor to said torque transfer assembly;

wherein manual operation of said winding means and/or power-assisted operation of said winding means provides selective rotational movement of said spool in relation to said enclosure whereby hose winding to a compact configuration is accomplished.

16. The hose winding apparatus in accordance with claim 15, wherein said locking tab is connected to said crank by a living hinge.

17. A direct current powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a hose winding guide comprising:

a double helix lead screw, said double helix lead screw substantially parallel to and spaced apart from said spool axis of rotation and suitably supported and journaled in said left and said right side wall panels;

a guide rod substantially parallel to said spool axis of rotation, suitably supported by said left and said right side wall panels;

a carriage, said carriage constructed and arranged to cooperate with said double helix lead screw and said guide rod; and a hose guide geartrain, said gear train constructed and arranged to transfer rotary motion from said spool to said double helix lead-screw;

a follower assembly, said follower assembly constructed and arranged to cooperatively engage said lead-screw, wherein said follower assembly is manually disengageable from said leadscrew and manually re-engageable to said lead-screw, wherein said hose can be manually pulled from said spool without reciprocation of said hose winding guide and said hose winding guide is repositionable and re-engageable to said lead-screw;

a winding means constructed and arranged to provide infinite rotational movement of said spool in relation to said enclosure;

a direct current energized power-assist means constructed and arranged to selectively and operatively engage said winding means, said power-assist means including a direct current motor, said direct current motor including an armature and an output shaft, wherein rotation of said armature causes rotation of said output shaft;

a torque transfer assembly operatively coupled to said direct current motor output shaft and said winding means for selective driving thereof to cause rotation of said spool;

a control assembly, said control assembly constructed and arranged to control power supplied to said direct current motor; and a clutch assembly suitably coupled to said direct current motor output shaft for transferring rotational torque from said direct current motor to said torque transfer assembly;

wherein manual operation of said winding means and/or power-assisted operation provides selective rotational movement of said spool in relation to said enclosure whereby hose winding to a compact configuration is accomplished.

18. The hose winding apparatus in accordance with claim 17, wherein said follower assembly is constructed and arranged for automatic disengagement;

wherein said follower assembly disengages said lead-screw thereby preventing said carriage from traversing said leadscrew in the event said carriage path becomes obstructed.

19. The hose winding apparatus in accordance with claim 18 wherein said control assembly further includes a direct current power source.

20. A direct current powered hose winding apparatus for use with an associated flexible hose comprising:

an enclosure having side panels, front and rear panels extending between said side panels, and a cover;

a spool positioned between said side panels and operably connected thereto for rotation of said spool about an axis of rotation, said spool having a hub defining said axis of rotation and a pair of flanges at opposing ends of said hub and perpendicular to said axis of rotation;

a winding means constructed and arranged to provide infinite rotational movement of said spool in relation to said enclosure;

a direct current energized power-assist means constructed and arranged to selectively and operatively engage said winding means, said power-assist means including a direct current motor, said direct current motor including an armature and an output shaft, wherein rotation of said armature causes rotation of said output shaft;

a torque transfer assembly operatively coupled to said direct current motor output shaft and said winding means for selective driving thereof to cause rotation of said spool;

a control assembly, said control assembly constructed and arranged to control power supplied to said direct current motor; and a clutch assembly suitably coupled to said direct current motor output shaft for transferring rotational torque from said direct current motor to said torque transfer assembly, said clutch assembly including a first mating surface and a second mating surface, wherein said first mating surface and said second mating surface are constructed and arranged for variable operator controlled frictional engagement with each other upon rotation of said direct current motor output shaft, wherein said variable engagement delivers variable torque and rotation speed to said torque transfer assembly;

wherein manual operation of said winding means and/or power-assisted operation of said winding means provides selective rotational movement of said spool in relation to said enclosure whereby hose winding to a compact configuration is accomplished.

21. The hose winding apparatus in accordance with claim 20 wherein said direct current motor further includes an output shaft and an output shaft speed reducer, said direct current motor output shaft speed reducer constructed and arranged to increase rotational torque provided by said direct current motor output shaft and reduce rotational speed of said direct current motor output shaft;

wherein said output shaft speed reducer is coupled between an armature of said direct current motor and said direct current motor output shaft.

22. The hose winding apparatus in accordance with claim 20, wherein said clutch assembly is a cone clutch, wherein said first mating surface has a generally frustoconical shape, wherein said second mating surface is a generally frustoconically shaped bore, wherein said first and said second surfaces are axially aligned and wherein said first and said second mating surfaces utilize operator controlled friction to selectively rotate said torque transfer assembly.

23. The hose winding apparatus in accordance with claim 20, wherein said clutch assembly is a plate clutch, wherein said first mating surface is generally a disk, wherein said second mating surface is generally a disk, wherein said first and said second surfaces are axially aligned and wherein said first and said second mating surfaces utilize operator controlled friction to selectively rotate said spool to selectively rotate said torque transfer assembly.

24. The hose winding apparatus in accordance with claim 20, wherein said torque transfer assembly includes a second assembly coupled to said enclosure for pivotally supporting a cantilever, said cantilever having a first end and a second end, said first end of said cantilever constructed and arranged to control engagement of said clutch assembly, said second end of said cantilever constructed and arranged to provide a foot pedal for operator modulation of said clutch assembly.

25. The hose winding apparatus in accordance with claim 24, wherein said control assembly further comprises a main power switch for electrically connecting and disconnecting said direct current motor to and from said direct current power source.

26. The hose winding apparatus of claim 25 wherein said direct current power source is a battery assembly, constructed and arranged for electrically polarized and mechanical engagement with said control assembly.

27. The hose winding apparatus in accordance with claim 26, wherein operation of said cantilever further operates said main power switch, wherein electrical connection is made between said direct current motor and said direct current power source during operation of said foot pedal and power is disconnected between said direct current motor and said direct current power source when said foot pedal is not operated.

28. The hose winding apparatus in accordance with claim 24, wherein said foot pedal is pivotally mounted to said second end of said cantilever for movement between a operational position and a storage position, wherein said foot pedal is substantially axially aligned with said cantilever in said operational position and wherein said foot pedal is substantially perpendicular with respect to said cantilever in said storage position.

29. The hose winding apparatus in accordance with claim 20, wherein said control assembly further comprises at least one safety interlock for disabling said main power switch and preventing electrical connection between said direct current motor and said power source.

30. The hose winding apparatus in accordance with claim 29 wherein said left and said right side panels each include a front edge, a back edge, an inner surface and an outer surface, wherein at least one integrally formed contoured socket extending extends inwardly from said inner surface and substantially perpendicular and adjacent to said front and said back edges thereof, said sockets being adapted to accept locking posts extending outwardly from said left and said right edges of said front and said rear panels, wherein said left, right, front and rear panels interlock to form said enclosure.

31. The hose winding apparatus in accordance with claim 30 wherein said rear panel includes a left edge and a right edge, wherein each of said left and said right edges include at least one integrally formed locking post extending outwardly from each of said edges, said locking posts constructed and arranged to cooperate with said left and said right side panel sockets for interlocking engagement.

32. The hose winding apparatus in accordance with claim 29 wherein said left and said right side panels include a wheel recess integrally formed therein, said wheel recess positioned at a lower rear portion of said panels, said wheel recesses each including a centrally located wheel assembly aperture therethrough for accepting a portion of a wheel assembly.

33. The hose winding apparatus in accordance with claim 32 wherein said right side panel wheel recess includes a foot pedal aperture therethrough, wherein said second end of a cantilever extends through said aperture, wherein a foot pedal extends outwardly with respect to said side panel when said foot pedal in an operational position, wherein said foot pedal is recessed with respect to said side panel when said foot pedal in a storage position to prevent inadvertent operation of said foot pedal.

34. The hose winding apparatus in accordance with claim 32, wherein said wheel assembly includes a wheel member and an axle stub member, said axle stub adapted for receipt in said wheel assembly apertures to secure said wheel to said enclosure.

35. The hose winding apparatus in accordance with claim 34, wherein said axle stub member includes a first end constructed and arranged for interlocking engagement with said wheel assembly apertures and a second end includes a thrust plate, said thrust plate constructed and arranged for locating said wheel, wherein said axle stub extends through a central portion of said wheel for interlocking engagement with said rear panel and said thrust plate abuts said wheel to secure said wheel to said enclosure.

36. The hose winding apparatus in accordance with claim 20, wherein said enclosure comprises:

a left and a right side wall panel, front and rear wall panels, extending between said left and said right side wall panels, and a cover, said enclosure being configured for receiving said spool so as to permit said spool to rotate about an axis of rotation within said enclosure, wherein said cover is pivotally mounted to said enclosure for movement between a closed position and an open position, wherein said front wall panel includes a cut-out portion at about a top edge thereof adjacent a junction with said cover when said cover is in said closed position, wherein said cut-out is configured for traversing a portion of said flexible hose therethrough to take-up and pay-out said hose with said cover in said closed position, wherein at least one wheel is rotatably mounted at a lower rear portion of each of said left and said right side panels.

37. The hose winding apparatus in accordance with claim 36 wherein said left and said right side panels each include at least one rubber pad fixedly secured to a bottom surface of each of said left and right side panels for engaging a surface to resist skidding of said hose winding device during operation.

38. The hose winding apparatus in accordance with claim 36 wherein said rear panel includes a telescoping handle assembly, wherein said telescoping handle assembly is moveable between a storage position and an in-use position, wherein said rear panel member includes at least one integrally formed channel constructed and arranged to guide said telescoping handle assembly during movement between said storage and said inuse positions.

39. The hose winding apparatus in accordance with claim 38 wherein telescoping handle assembly includes a pair of spaced apart telescoping members and a handle member extending between said telescoping members, wherein said telescoping members each include at least one detent and wherein said rear panel includes two integrally formed channels, wherein said channels each include at least one protrusion constructed and arranged to cooperate with said telescoping member detents to secure said handle assembly in at least one predetermined position.

40. The hose winding apparatus in accordance with claim 36 wherein said rear panel includes a pair of wheel assembly receivers each constructed and arranged to cooperate with a wheel assembly, wherein one of said wheel assembly receivers is integrally formed into a left edge of said rear panel and one of said wheel assembly receivers is integrally formed into a right edge of said rear panel, wherein said wheel assembly receivers are positioned to align with a left and a right side panel wheel assembly aperture.

41. The hose winding apparatus in accordance with claim 36 wherein said rear panel includes a pair of integrally formed hinge pin bosses, wherein said hinge pin bosses extend upwardly from a top edge of said rear panel, wherein a hinge pin extends from each of said hinge pin bosses about laterally and in axial alignment with respect to each other, wherein said hinge pins are constructed and arranged to cooperate with said cover to allow pivotal movement thereof.

42. The hose winding apparatus in accordance with claim 36 wherein said rear panel includes a pair of integrally formed hooks, wherein said hooks are constructed and arranged to cooperate with a basket member for securing said basket member thereto, wherein said basket member is constructed and arranged to fit within said enclosure.

43. The hose winding apparatus in accordance with claim 36 wherein said cover includes a depending lip extending around the perimeter of said cover, said depending lip including a front, a rear, a left and a right surface, said rear surface including a pair of pockets constructed and arranged to cooperate with said hinge pins, each said pocket configured to permit rotational movement of said pins for upward rotational movement of said cover.

44. The hose winding apparatus in accordance with claim 36 wherein said cover further includes at least one safety interlock for disabling said power-assist means;

wherein motorized rewinding of said hose is locked out when said cover is in an open position, and motorized rewinding of said hose is operable when said cover is in the closed position.

45. The hose winding apparatus in accordance with claim 44, wherein said safety interlock includes a switching means, said switching means constructed and arranged to cooperate with said cover of said enclosure.

46. The hose winding apparatus in accordance with claim 45, wherein said switching means includes at least one electrical switch, said electrical switch operable by said cover to disconnect said power source from said direct current motor when said cover is in the open position.

47. The hose winding apparatus in accordance with claim 20, wherein said hose winding apparatus further includes a hose winding guide comprising:

a double helix lead screw, said double helix lead screw substantially parallel to and spaced apart from said spool axis of rotation and suitably supported and journaled in said left and said right side wall panels;

a guide rod substantially parallel to said spool axis of rotation, suitably supported by said left and said right side wall panels;

a carriage, said carriage constructed and arranged to cooperate with said double helix lead screw and said guide rod; and a hose guide gear-train, said gear train constructed and arranged to transfer rotary motion from said spool to said double helix lead-screw;

wherein said carriage reciprocates back and forth across said lead screw and said guide rod when said spool is rotated to uniformly and smoothly wrap said hose on said spool for a compact storage configuration.

48. The hose winding apparatus in accordance with claim 47, wherein said carriage includes a follower assembly, said follower assembly constructed and arranged to cooperatively engage said leadscrew.

49. The hose winding apparatus in accordance with claim 48, wherein said follower assembly is manually disengageable from said lead-screw and manually re-engageable to said lead-screw;

wherein said hose can be manually pulled from said spool without reciprocation of said hose winding guide and said hose winding guide is repositionable and re-engageable to said lead-screw.

50. The hose winding apparatus in accordance with claim 49, wherein said follower assembly is constructed and arranged for automatic disengagement;

wherein said follower assembly disengages said lead-screw thereby preventing said carriage from traversing said lead-screw in the event said carriage path becomes obstructed.

51. The hose winding apparatus in accordance with claim 47, wherein said hose guide gear-train includes:

a spool gear, said spool gear secured to said hub of said spool, said spool suitably journaled in said enclosure to allow rotational movement of said spool;

a driven gear, said driven gear suitably attached to said lead-screw of said hose winding guide assembly;

at least one idler gear, said at least one idler gear rotationally secured within said enclosure and intermeshing with said drive gear and said spool gear;

wherein said spool gear provides rotation of said at least one idler gear and said at least one idler gear provides rotation of said driven gear and said lead-screw secured thereto.

* * * * *